US005654681A

United States Patent [19]

Ishizaki et al.

[11] Patent Number: 5,654,681

[45] Date of Patent: Aug. 5, 1997

[54] LAMINATED DIELECTRIC RESONATOR AND DIELECTRIC FILTER

[75] Inventors: Toshio Ishizaki, Hyogo; Hideaki Nakakubo, Kyoto, both of Japan

[73] Assignee: Matsushita Electric Industrial Co., Ltd., Osaka, Japan

[21] Appl. No.: 532,303

[22] Filed: Sep. 22, 1995

Related U.S. Application Data

[62] Division of Ser. No. 217,118, Mar. 24, 1994, Pat. No. 5,479,141 .

[30] Foreign Application Priority Data

Mar. 25, 1993 [JP] Japan ..... 5-066315

[51] Int. Cl.[6] ..... H01P 1/20

[52] U.S. Cl. ..... 333/204; 333/202; 333/219

[58] Field of Search ..... 333/202–205, 333/219, 246, 185

[56] References Cited

U.S. PATENT DOCUMENTS

| | | | |
|---|---|---|---|
| 5,051,712 | 9/1991 | Naito et al. | 333/185 |
| 5,248,949 | 9/1993 | Eguchi et al. | 333/204 |
| 5,300,903 | 4/1994 | Okamura et al. | 333/219 |
| 5,346,201 | 9/1994 | Ishizaki et al. | 333/219 |
| 5,351,020 | 9/1994 | Okamura et al. | 333/185 |
| 5,374,904 | 12/1994 | Hirai et al. | 333/204 |
| 5,382,425 | 1/1995 | Hayashi et al. | 333/112 |
| 5,404,118 | 4/1995 | Okamura et al. | 333/219 |
| 5,479,141 | 12/1995 | Ishizaki et al. | 333/204 |

FOREIGN PATENT DOCUMENTS

| | | |
|---|---|---|
| 1222501 | 9/1989 | Japan . |
| 2-290303 | 11/1990 | Japan . |
| 4273608 | 9/1992 | Japan . |

OTHER PUBLICATIONS

Nishikawa, Toshio, RF Front End Circuit Components Miniaturized Using Dielectric Resonators for Cellular Portable Telephones, vol. E. 74, No. 6, Jun. 1991.

Kagata, Hiroshi et al., Low-Fire Microwave Dielectric Ceramics and Multilayer Devices With Silver Internal Electrode, vol. 32, 1993.

*Primary Examiner*—Benny T. Lee
*Assistant Examiner*—Darius Gambino
*Attorney, Agent, or Firm*—McDermott, Will & Emery

[57] ABSTRACT

In a laminated dielectric resonator, twomo strip line is formed and resonant frequency is lowered. Accordingly, the length of the resonator is reduced, and the length of the strip line becomes shorter than one fourth of the wavelength with the lowered resonant frequency, which leads to further reduction of the length of the resonator. By lowering the resonant frequency, dielectric material with less relative permittivity can be used, with a result of resonator with high unloaded Q and excellent temperature characteristic. Further, at least one coupling electrode is formed as external or internal electrode to compose a capacitor together with a second strip line, and a laminated dielectric resonator is connected to an external circuit via the coupling electrode. A dielectric filter such as band pass filter, band elimination filter is so composed that the dielectric resonators are cascade-connected to one another. In the thus constructed dielectric filter, external coupling capacitors are unnecessary, reducing the number of parts and facilitating the manufacturing process. Thus, a small-sized, low-cost dielectric filter is attained.

22 Claims, 16 Drawing Sheets

LAMINATED DIELECTRIC RESONATOR AND DIELECTRIC FILTER

This is a divisional of application Ser. No. 08/217,118, filed Mar. 24, 1994, patented Dec. 26, 1995, U.S. Pat. No. 5,479,141.

BACKGROUND OF THE INVENTION

This invention relates to a laminated dielectric resonator and a dielectric filter which are chiefly used in high-frequency radio tools such as a portable phone. The laminated dielectric resonator is solely used as a resonant element such as a high-frequency oscillation circuit, or used, as combination of a plurality of laminated dielectric resonators, for composing a dielectric filter working as a band-pass filter or a band elimination filter.

Accompanied by development of vehicular communication, small-sized portable phones have been desired. Size reduction of parts to be used therein is the key for reducing the size of high-frequency radio tool such as a portable phone. Since a dielectric filter widely used as a high-frequency filter is one of high-frequency parts which largely occupies the radio circuit of the portable phone, the size reduction thereof is desired.

The dielectric filter is composed of a plurality of dielectric resonators which are cascade-connected to one another via joint elements. Conventionally, a coaxial dielectric resonator in which an electrode is formed on a surface of coaxial ceramic element is used for the dielectric resonator, and the conventional dielectric filter is composed of the coaxial dielectric resonators. However, since micro-fabrication of the ceramic in manufacturing the coaxial dielectric resonator is too limited to be thinned, a laminated dielectric resonator which is composed of a plane-type strip line resonator is contemplated.

One example of the conventional laminated dielectric resonators is explained, with reference to drawings. FIG. 15(*a*) is a perspective exploded view of the conventional laminated dielectric resonator. FIG. 15(*b*) is a section, taken along a line X–X' in FIG. 15(*a*).

In FIGS. 15(*a*), (*b*), a strip line 36 is formed on a first dielectric sheet 35, and shield electrodes 7 are respectively provided on and under the strip line 36 via dielectric sheets 35, 37 laminated thereon and thereunder. One end of the strip line 36 is grounded via a ground electrode 9 so as to compose an end-short strip line resonator. Impedance at an open end is infinite with a frequency corresponding to a wavelength of electromagnetic wave which is as four times as the length of the strip line 36, so as to perform parallel resonance. Such a laminated dielectric resonator is disclosed, for example, in FIG. 1 of Laid Open unexamined Japanese Patent Application No. 2-290303.

Under the above construction, however, the resonator can be thinned but has conventional length. The dielectric ceramic material to be laminated is so limited that the dielectric material is limited to low-permittivity material, with a result of longer resonator than the conventional one. In order to reduce the whole length of the resonator, a relative permittivity of the dielectric material must be high because the resonant frequency depends on propagation wavelength on the strip line. However, the dielectric material with high relative permittivity is generally burnt with too high temperature to burn with an electrode (hereinafter referred to it as internal electrode) arranged in the dielectric material, which restrains the size reduction. Further, the dielectric material with high relative permittivity generally has a large dielectric loss tangent which lowers unloaded Q of the laminated dielectric resonator, with inferior temperature characteristic with respect to frequency. As a result, the characteristic of the laminated dielectric resonator is degraded.

The above-mentioned Japanese reference proposes that a strip line is formed on each of two dielectric sheets laminated, and the strip lines are connected to each other to be formed in two-fold configuration. However, while reducing the physical length of the resonator by the two-fold configuration, further reduction thereof is difficult.

FIG. 16 is a perspective exploded view of an antenna duplexer composed of a conventional dielectric filter. The antenna duplexer is so composed that two filters of a transmission filter and a receiving filter are combined. The prior art dielectric filter is explained below, referring to the antenna duplexer in the figure as an example. In FIG. 16, reference numerals 701–706 denote coaxial dielectric resonators, 707 denotes a coupling substrate, 708 denotes a metallic case, 709 denotes a metallic cover, 710–712 denote series capacitors, 718 and 714 denote inductors, 715–718 denote coupling capacitors, 721–726 denote connection pins, 731 denotes a transmission terminal, 732 denotes an antenna terminal, 733 denotes a receiving terminal, and 741–747 denote electrode patterns formed on the coupling substrate 707.

The coaxial dielectric resonators 701, 702, 703, the series capacitors 710, 711, 712 and the inductors 713, 714 compose a transmission band elimination filter. The coaxial dielectric resonators 704, 705, 706 and the coupling capacitors 715, 716, 717, 718 compose a receiving band pass filter.

The transmission filter is connected at one end thereof to the transmission terminal 731 to be electrically connected to a transmitter, and is connected at the other end thereof to one end of the receiving filter and to the antenna terminal 732 to be electrically connected to an antenna. The other end of the receiving filter is connected to the receiving terminal 733 to be electrically connected to a receiver. The antenna duplexer composed of the conventional dielectric filter under such a construction is disclosed, for example, in FIG. 4 of "RF Front End Circuit Components Miniaturized Using Dielectric Resonators For Cellular Portable Telephones" by T. Nishikawa, IEICE Transactions, Vol. E74, No.6, pp.1556–1562, June, 1991.

However, such a construction requires a number of electronic parts such as capacitors and inductors or mechanical parts such as connection pins, which involves a problem that reduction of size and cost is difficult.

SUMMARY OF THE INVENTION

This invention has its object of providing small-sized, low-cost laminated dielectric resonator and dielectric filter by reducing the length of the resonator more than length reduction by the folded configuration of the strip line, while maintaining excellent performance thereof.

To attain the above object, in The present invention, the strip line is folded in two-fold and the resonant frequency is lowered, thereby the strip line is further decreased in length to decrease the length of the resonator.

A laminated dielectric resonator in the present invention comprises:

a first dielectric sheet;

a second dielectric sheet laminated on the first dielectric sheet;

a first strip line formed on a surface of the first dielectric sheet;

a second strip line formed on a surface of the second dielectric sheet;

an uppermost dielectric sheet and a lowermost dielectric sheet respectively laminated on an upper surface and a lower surface of a laminated body of the first dielectric sheet and second dielectric sheet, a first shield electrode provide at a lower surface of the lowermost dielectric sheet;

a second shield electrode provided at an upper surface of the uppermost dielectric sheet:

a connection electrode which connects one end of the first strip line to one end of the second strip line; and a ground electrode which grounds the other end of the first strip line, wherein the other end of the second strip line is opened, and a distance t1 between the first shield electrode and the first strip line is set different from a distance t2 between the first strip line and the second strip line and a distance t3 between the second strip line and the second shield electrode.

Another laminated dielectric resonator in the present invention comprises:

a first dielectric sheet;

a second dielectric sheet;

a third dielectric sheet;

a first strip line formed on an upper surface of the first dielectric sheet;

a second strip line formed on an upper surface of the second dielectric sheet;

a capacitor electrode formed on an upper surface of the third dielectric sheet;

uppermost and lowermost dielectric sheets respectively laminated on an upper surface and a lower surface of a laminated body of first, second and third dielectric sheets;

a first shield electrode provided on a lower surface of the lowermost dielectric sheet;

a second shield electrode provided on an upper surface of the uppermost dielectric sheet;

a connection electrode which connects one end of the first strip line to one end of the second strip line; and a ground electrode which grounds the other end of the first strip line and the capacitor electrode, wherein regions of the first strip line, the second strip line and the capacitor electrode are overlapped, the other end of the second strip line is opened, a distance t1 between the first shield electrode and the first strip line is set different from a distance t2 between the first strip line and the second strip line and a distance t3 between the second strip line and the second shield electrode.

Further, in the present invention, the distances t1, t2, t3 are set to t1>t2>t3, t1>t3>t2 or t1=t2+t3.

At least one coupling electrode connected to an external circuit is provide to compose a coupling capacitor together with the second strip line.

In addition, the plural laminated dielectric resonator having the coupling capacitors are cascade-connected to one another.

According to the above construction, in the laminated dielectric resonator in the present invention, the distance t1 between the first shield electrode and the first strip line is set different from the distance t2 between the first strip line and the second strip line and the distance t3 between the second strip line and the second shield electrode, in detail, set to be t1>t2>t3, t1>t3>t2 or t1=t2+t3. Thus, the characteristic impedances of the second strip line and the third strip line are lower than that of the first strip line. Consequently, the resonator composed of the strip lines are in SIR structure in which the impedance is changed in steps at an intermediate part, with lowered resonant frequency. As a result, the length of the resonator is reduced more than the physical length thereof by each two-fold strip line.

By adding the capacitor electrode, the capacitor composed of the capacitor electrode and the first strip line is connected in parallel to the resonator, which increases capacity component of the resonator. This lowers the resonant frequency further and reduces the length of the resonator further.

Moreover, by the lowering of the resonant frequency, dielectric material with less relative permittivity can be used. As a result, laminated dielectric resonator with high unloaded Q and excellent temperature characteristic is contemplated.

In addition, in the dielectric filter in the present invention, since the plural laminated dielectric resonators including the coupling capacitors are cascade-connected to one another, the dielectric filter is easily constructed without additional coupling capacitors and the like, reducing the number of parts and simplifying the manufacturing process, with a result of low-cost, small-sized dielectric filter.

BRIEF DESCRIPTION OF THE DRAWINGS

Accompanying drawings show preferred embodiments of the present invention, in which:

FIG. 1(*b*) is a section, taken along a line X–X' in FIG. 1(*a*);

FIG. 2(*b*) is a section, taken along a line X–X' in FIG. 2(*a*);

FIG. 3(*b*) is a section, taken along a line X–X' in FIG. 3(*a*);

FIG. 3(*c*) is an equivalent circuit diagram showing operation of the laminated dielectric resonator according to the third embodiment;

FIG. 4(*b*) is a section, taken along a line X–X' in FIG. 4(*a*);

FIG. 5(*b*) is a section, taken along a line X–X' in FIG. 5(*a*);

FIG. 6(*b*) is an equivalent circuit diagram showing operation of the dielectric filter according to the fourth embodiment;

FIG. 7(*b*) is a section, taken along a line X–X' in FIG. 7(*a*);

FIG. 8(*b*) is a section, taken along a line X–X' in FIG. 8(*a*);

FIG. 8(*c*) is an equivalent circuit diagram showing operation of the laminated dielectric resonator having the capacitor electrode in FIG. 8(*a*);

FIG. 9(*b*) is a section, taken along a line X–X' in FIG. 9(*a*);

FIG. 9(*c*) is an equivalent circuit diagram showing operation of the laminated dielectric resonator having the capacitor electrode in FIG. 9(*a*);

FIG. 10(*b*) is a section, taken along a line X–X' in FIG. 10(*a*);

FIG. 13(*b*) is a section, taken along a line X–X' in FIG. 13(*a*);

FIG. 13(*c*) is an equivalent circuit diagram showing operation of the laminated dielectric resonator according to the eighth embodiment.

FIG. 14(*b*) is an equivalent circuit diagram showing operation of the dielectric filter according to the ninth embodiment;

FIG. 15(*b*) is a section, taken along a line X–X' in FIG. 15(*a*);

DETAILED DESCRIPTION OF THE INVENTION

Description is made below about laminated dielectric resonators and dielectric filters according to each preferred embodiment of the present invention, with reference to accompanying drawings.

(FIRST EMBODIMENT)

Figure 1A:
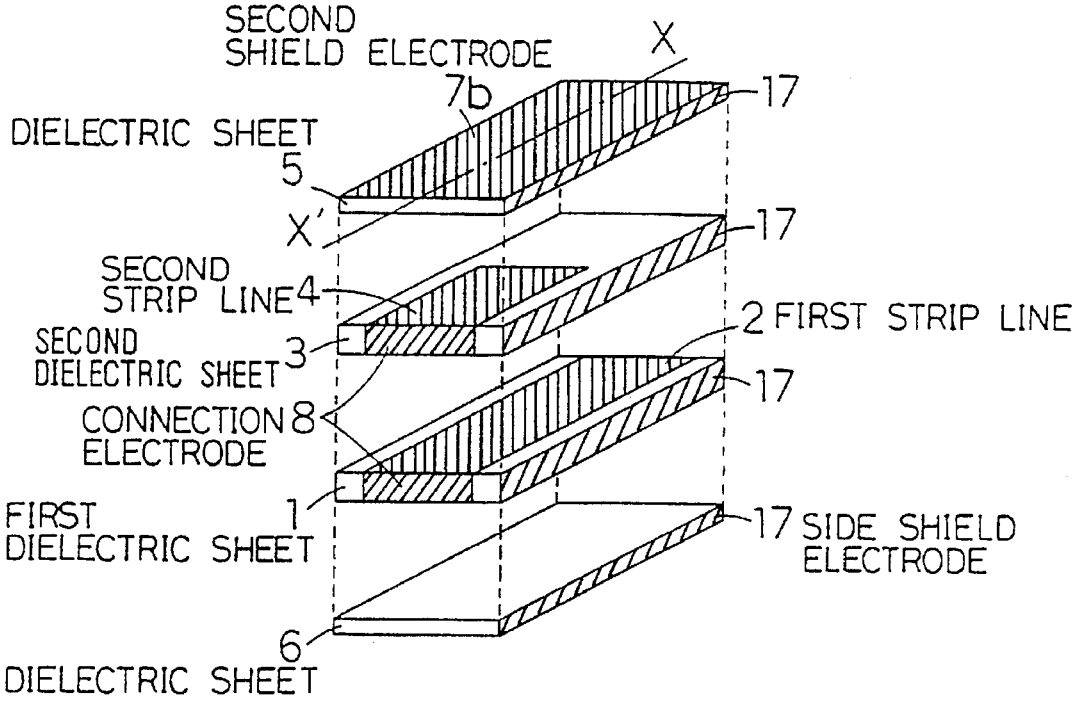
FIG. 1(*a*) is a perspective exploded view of a laminated dielectric resonator according to a first embodiment.
Figure 1B:
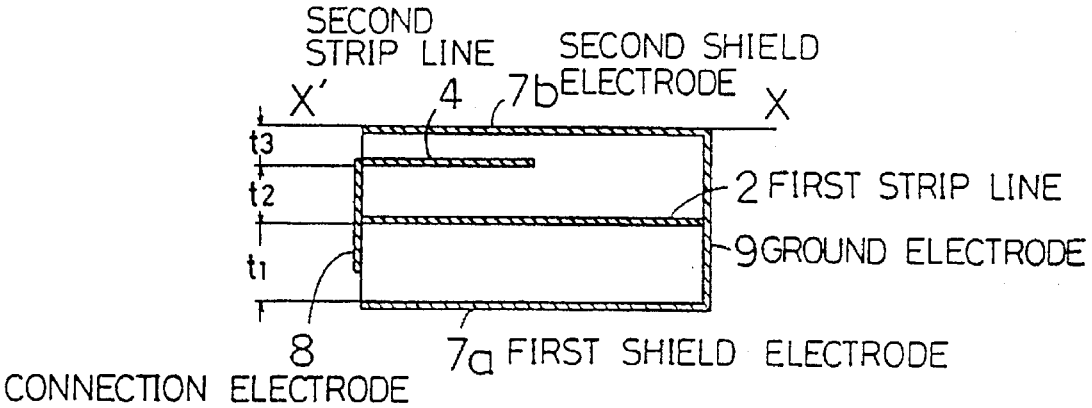

FIG. 1(*a*) is a perspective exploded view of a laminated dielectric resonator according to the first embodiment of the present invention, and FIG. 1(*b*) is a section, taken alone a line X–X' in FIG. 1(*a*).

In FIG. 1(*a*), reference numeral 1 denotes a first dielectric sheet, 3 denotes a second dielectric sheet, 5 and 6 denote uppermost and lowermost dielectric sheets respectively. In these dielectric sheets, a low-temperature sintered dielectric ceramic that a ceramic material of Bi—Ca—Nb—O system with 58 relative permittivity is made in the form of green sheet is used as the dielectric sheets 1, 3, 5, 6, as indicated in "Low-fire Microwave Dielectric Ceramics and Multilayer Devices with Silver Internal Electrode", by H. Kagata et al., Ceramic Transactions, Vol.32, The American Ceramic Society Inc., pp.81–90.

The first dielectric sheet 1 is laminated on the lowermost dielectric sheet 6. A first strip line 2 is formed on the first dielectric sheet 1 so as to extend from one end to the other end of the dielectric sheet 1 by means of thick-film printing of conductor such as silver paste, copper paste. The second dielectric sheet 3 is laminated on the first dielectric sheet 1 at which the first strip line 2 is formed. A second strip line 4 shorter than the first strip line 2 is formed on the second dielectric sheet 3 so as to extend from one end to the other end of the second dielectric sheet 3 by the same means as in the case of the first strip line 2. The uppermost dielectric sheet 5 is laminated on the second dielectric sheet 3 at which the second strip line 4 is formed. The dielectric sheets 1, 3, 5, 6 are pressed, and burnt concurrently with internal electrodes (i.e., first and second strip lines 2, 4).

A first shield electrode 7*a* and a second shield electrode 7*b* are respectively formed on a lower surface of the thus burnt result (i.e., lowermost dielectric sheet 6) and an upper surface thereof (i.e., uppermost dielectric sheet 5) as external electrodes (in detail, electrodes located on a surface of laminated dielectric resonator).

Side shield electrodes 17 are formed, as external electrodes, at both entire sides of the thus burnt result (i.e., four dielectric sheets 1, 3, 5, 6) in the width direction of the strip lines 2, 4.

Further, a connection electrode 8 is formed, as an external electrode, at one side surface of the laminated body of first and second dielectric sheets 1, 3 in the longitudinal direction of the strip lines 2, 4, and one end of the first strip line 2 and one end of the second strip line 4 are connected to each other via the connection electrode 8.

In addition, a ground electrode 9 is formed, as an external electrode, on the other entire side surface of the thus laminated result of the four dielectric sheets 1, 3, 5, 6 in the longitudinal direction of the strip lines 2, 4, and the other end of the first strip line 2 is grounded via the ground electrode 9.

Each external electrode is formed in such a manner that silver paste mixed with glass frlt for thick-film printing, or the like is coated on the surface, then is burnt. The connection electrode 8 also serves as connection terminal to an external circuit.

By connecting the end of the fist strip line 2 to the end of the second strip line 4, the laminated dielectric resonator with the above construction works as an end-short strip line resonator with one fourth wavelength, an intermediate part on open end side of which is folded. In other words, by connecting in series the second strip line 4 to the first strip line 2, the folded-shape end-short strip line resonator is constructed, thus reducing the physical length of the resonator.

A capacitor is composed of the second strip line 4, the shield electrode 7 and the uppermost dielectric sheet 5 therebetween and a loading capacitor is inserted in parallel with the resonator, thus lowering the resonant frequency. Further, the uppermost dielectric sheet 3 laminated on the second dielectric sheet 3 is so thin, a distance between the shield electrode 7 of the uppermost dielectric sheet 5 and the second strip line 4 is so short and a distance between the first strip line 2 and the shield electrode 7 of the lowermost dielectric sheet 3 is so long that a characteristic impedance of the second strip line 4 is lower than that of the first strip line 2. In consequence, the resonator composed of the second strip line 4 and the first strip line 2 is in SIR structure (Stepped Impedance Resonator) in which the impedance is changed in steps at the intermediate part, so that the resonant frequency is further lowered (lowering of the resonant frequency by the SIR structure is referred to in, for example, "A Design Method of Bandpass Filters Using Dielectric- Filled Coaxial Resonators" by M. Sagawa et al., IEEE Transactions on Microwave Theory and Techniques, Vol. MTT33, No.2, February 1985, pp152–157).

As a result, in addition to the reduction of physical length, since the capacitor is formed and the resonant frequency is lowered by the SIR structure, the physical length of the resonator is remarkably reduced. For example, at 900 MHz frequency, the length of the resonator with one fourth wavelength which is formed on the dielectric sheet of 58 relative permittivity is 10.9 mm, while length of the laminated dielectric resonator in the present invention is reduced to 4.6 mm which is less than a half thereof.

Further, by lowering the resonant frequency, dielectric material with less relative permittivity can be used. Thus, the dielectric material with less dielectric loss tangent can be used without increasing the physical length of the resonator, enhancing unloaded Q of the resonator.

Each thickness of the dielectric sheets 1, 3, 5, 6 is set as follows. Suppose that a total thickness of the lowermost dielectric sheet 6 and the first dielectric sheet 1, i.e., a distance between the first shield electrode 7*a* and the first strip line 2 is t1, the thickness of the second dielectric sheet 3, i.e., a distance between the first strip line 2 and the second strip line 4 is t2, and the thickness of the uppermost dielectric sheet 5, i.e., a distance between the second strip line 4 and the second shield electrode 7*b* is t3. When t1>t2>t3, the capacitor formed between the second strip line 4 and the second shield electrode 7*b* becomes large because of the less distance of t3, thus lowering the resonant frequency. Also, a connection distance between the first strip line 2 and the second strip line 4 is long, so that the connection electrode 8 is elongated and the substantial length of the strip lines becomes long, which also lowers the resonant frequency. However, resistance loss and radiation loss of high-frequency current occurring at the connection electrode 8 degrades the unloaded Q of the resonator. Accordingly, when t1>t2>t3, the length of the resonator is further reduced, with slightly worse performance of the resonator.

When each thickness of the dielectric sheets 1, 3, 5, 6 is set to t1>t3>t2, reversely, while the effect of the length reduction of the resonator is slightly lowered, the resonator with remarkably high unloaded Q and high performance is obtained.

In this embodiment, each thickness of the dielectric sheets 1, 3, 5, 6 is set to t1=t2+t3 for further improving the performance of the resonator.

Because, since the magnetic field energy component is large on the grounded end side of the first strip line 2, a large distance between the first strip line 2 and the shield electrodes 7*a*, 7*b* on the grounded end side of the first strip line 2 is desired for reducing the loss of the resonator. The loss is mainly due to the shield electrode nearer the first strip line 2 out of the shield electrodes 7*a*, 7*b*. Suppose that the distance between upper and lower shied electrodes 7*a*, 7*b* is fixed, a condition for maximizing the minimum distances between the first strip line 2 and each shield electrode 7*a*, 7*b* on the grounded end side of the first strip line 2 is to equalize the distances between the first strip line 2 and two shield electrodes 7*a*, 7*b*, namely to set the distances to t1=t2+t3. Accordingly, under the above construction, the high-performance laminated dielectric resonator with short length is obtained. In both cases of t1>t2>t3 and t1>t3>t2, the resonant frequency can be lowered. The first shield electrode 7*a* may be formed on the lower surface of the dielectric sheet 1 without the lowermost dielectric sheet 6. In this case, the thickness of the first dielectric sheet 1 is set to t1.

Further, the side shield electrodes 17 formed on both sides of the laminated body shields completely the resonator, thus preventing electromagnetic interference between the laminated dielectric resonator and the external circuit and connection between the resonators in case where the laminated dielectric resonators are arranged adjacently. The side shield electrodes 17 connect upper and lower shield electrodes 7*a*, 7*b* so as no compellingly equalize the potential of the upper shield electrode 7*a* at the open end to the ground potential. This prevents unnecessary resonance of the shield electrode 7 at about the resonant frequency of the strip line resonator. As a result, with the side shield electrodes 17 formed, as the external electrodes, on both sides of the laminated body, the resonator with excellent shield characteristic and resonant characteristic is obtained.

In this embodiment, accordingly, the small-sized, high-performance laminated dielectric resonator is attained.

(SECOND EMBODIMENT)

Below, a laminated dielectric resonator according to the second embodiment of the present invention is discussed, with reference to the drawings.

Figure 2:
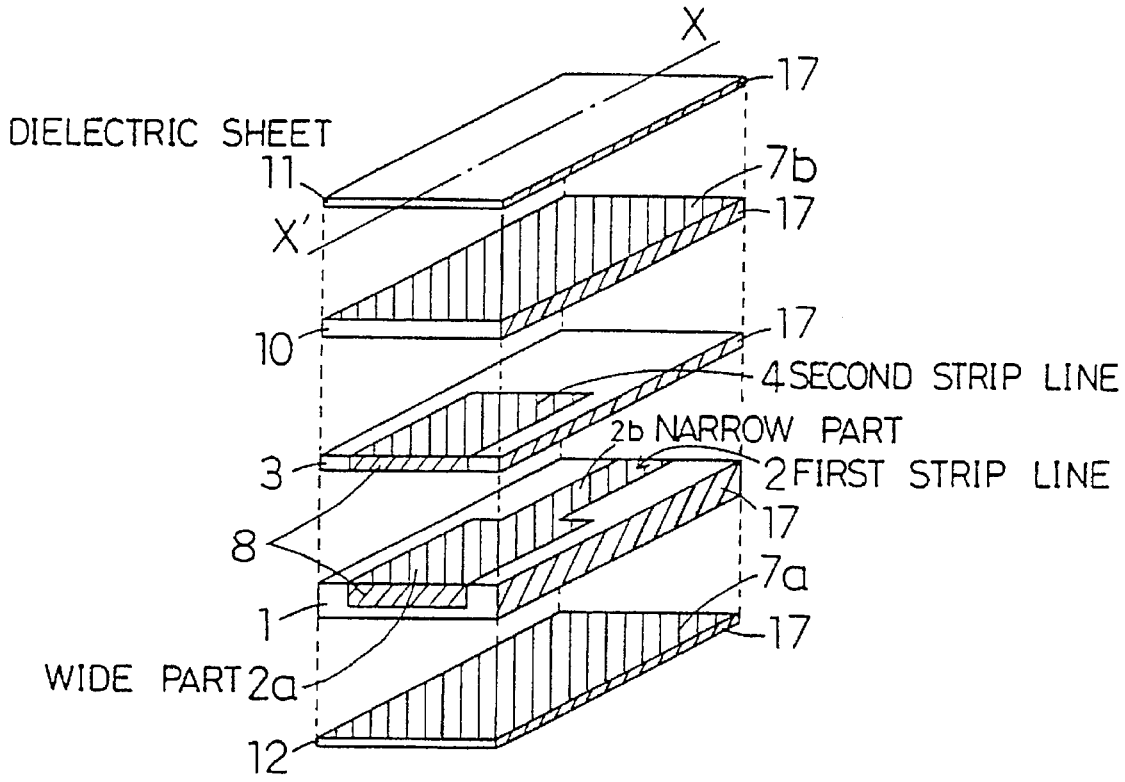
FIG. 2(*a*) is a perspective exploded view of a laminated dielectric resonator according to a second embodiment.
Figure 2B:
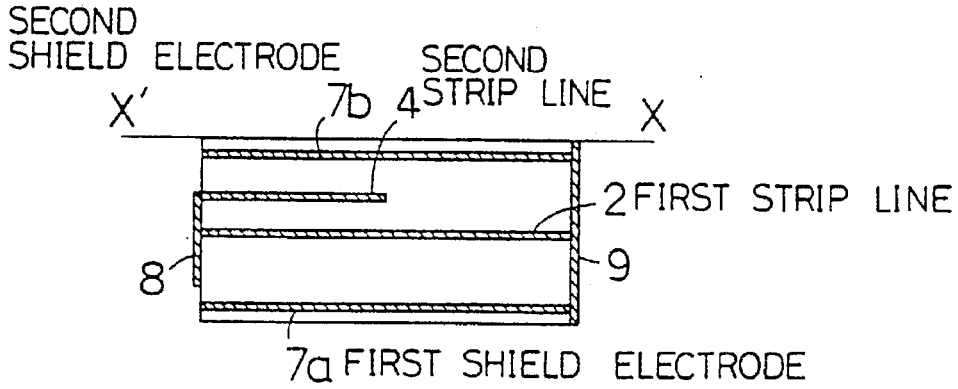

FIG. 2(*a*) is a perspective exploded view of the laminated dielectric resonator according to the second embodiment.

FIG. 2(*b*) is a section, taken along a line X–X' in FIG. 2(*a*). Wherein, as far as is possible the same references have been used as in the first embodiment, omitting the explanation thereof.

FIGS. 2(*a*), (*b*), the construction of the laminated dielectric resonator is the same as the that in the first embodiment, except following two points. One is that: while the line width of the first strip line 2 is equal from one end to the other end in the first embodiment, one end side of the first strip line 2 which is connected to the connection electrode 8 is made wide to be a wide part 2*a* and the other grounded end side of the first strip line 2 is made narrow to be a narrow part 2*b* to be in SIR structure that the impedance of the first strip line 2 is changed in steps from the intermediate part in this embodiment.

The other different point is that: while the shield electrodes 7*a*, 7*b* are formed on the surface as the external electrodes in the first embodiment, the shield electrodes 7*a*, 7*b* are respectively interposed, as internal electrodes, between a dielectric sheet 10 and a dielectric sheet 11 and between the dielectric sheet 1 and a dielectric sheet 12 in this embodiment. The side shield electrodes 17 are formed on both sides of the laminated body as the external electrodes, as well as in the first embodiment.

In the SIR type resonator, the larger the impedance step ratio is, the shorter the strip line of the resonator is. Under the construction in this embodiment, since the line width of the narrow part 2*b* formed on the grounded side of the first strip line 2 is narrower than the wide part 2*a* formed on the connection electrode 8 side, the characteristic impedance at the narrower part 2*b* is increased, with a result of large impedance step ratio.

In case where the shield electrodes are formed as the internal electrodes interposed between the dielectric sheets, the silver paste mixed with less glass frit for internal electrode can be used as the electrode paste, thus decreasing conductive loss of the resonator.

As described above, according to this embodiment, since the impedance step ratio in SIR is made larger, besides the effects and features in the first embodiment, each length of the strip lines is further shortened. In addition, the shield electrodes 7 as the internal electrodes can be made of material mixed with less glass frit, which improves unloaded Q.

(THIRD EMBODIMENT)

Below, a laminated dielectric resonator according to the third embodiment is discussed, with reference to the drawings.

Figure 3A:
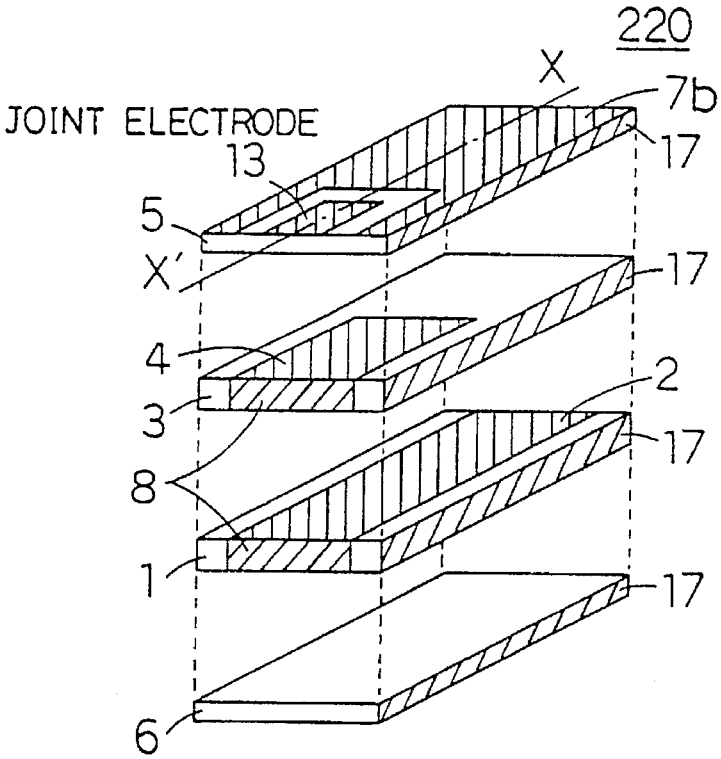
FIG. 3(*a*) is a perspective exploded view of a laminated dielectric resonator according to a third embodiment.
Figure 3B:
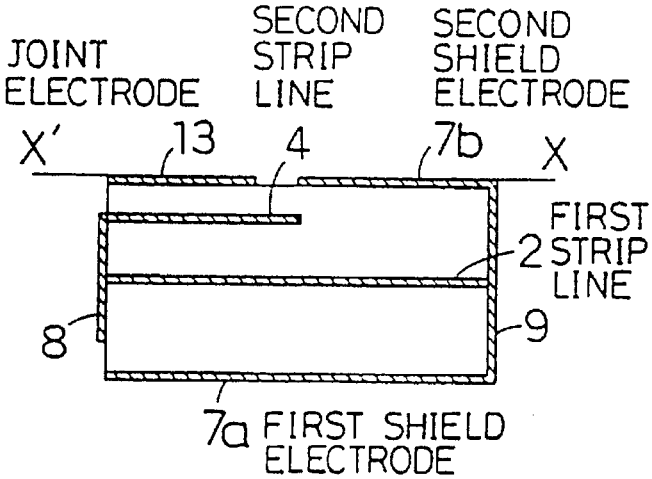
Figure 3C:
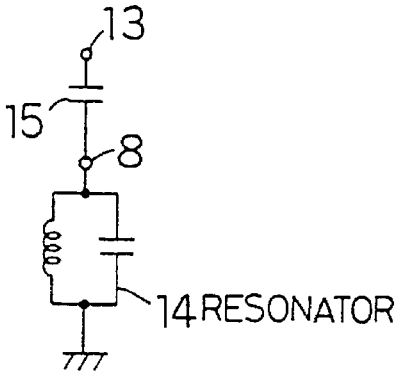

FIG. 3(*a*) is a perspective exploded view of the laminated dielectric resonator 220 according to the third embodiment of the present invention, FIG. 3(*b*) is a section, taken along a line X–X' in FIG. 3(*a*) and FIG. 3(*c*) is an equivalent circuit diagram of the laminated dielectric resonator 220.

FIGS. 3(*a*), (*b*), a different point of the laminated dielectric resonator 220 from that of the first embodiment is that: one coupling electrode 13 is formed, as an external electrode, on the same surface as the surface of the dielectric sheet 5 at which the second shield electrode **7*b* is formed, and the coupling electrode 13 composes a capacitor together with the second strip line 4** to connect the resonator to the external circuit. The other construction is the same as that in the first embodiment.

Operation of the laminated dielectric resonator 220 with the above construction is described, with reference to FIG. 3(*c*). The end-short strip line resonator in which the first strip line 2 and the second strip line 4 are connected to each other is regarded as to compose a parallel resonator 14 which resonates in parallel at about the resonant frequency.

Further, the second strip line 4 and the coupling electrode 13 form a capacitor 15. The coupling electrode 13 serves as a terminal for connecting the laminated dielectric resonator to the external circuit. In this circuit, since the capacitor is connected in series to the parallel resonant circuit, the laminated dielectric resonator 220 in the electrical characteristic, seen from the coupling electrode 13, has two resonances of series resonance and parallel resonance. In other words, the impedance is infinite at the parallel resonant frequency and is zero at the series resonant frequency. Hence, the laminated dielectric resonator 220 in this embodiment works as a single-step notch filter which damps signal component of the series resonant frequency.

(MODIFIED EXAMPLE OF THE THIRD EMBODIMENT)

Figure 4A:
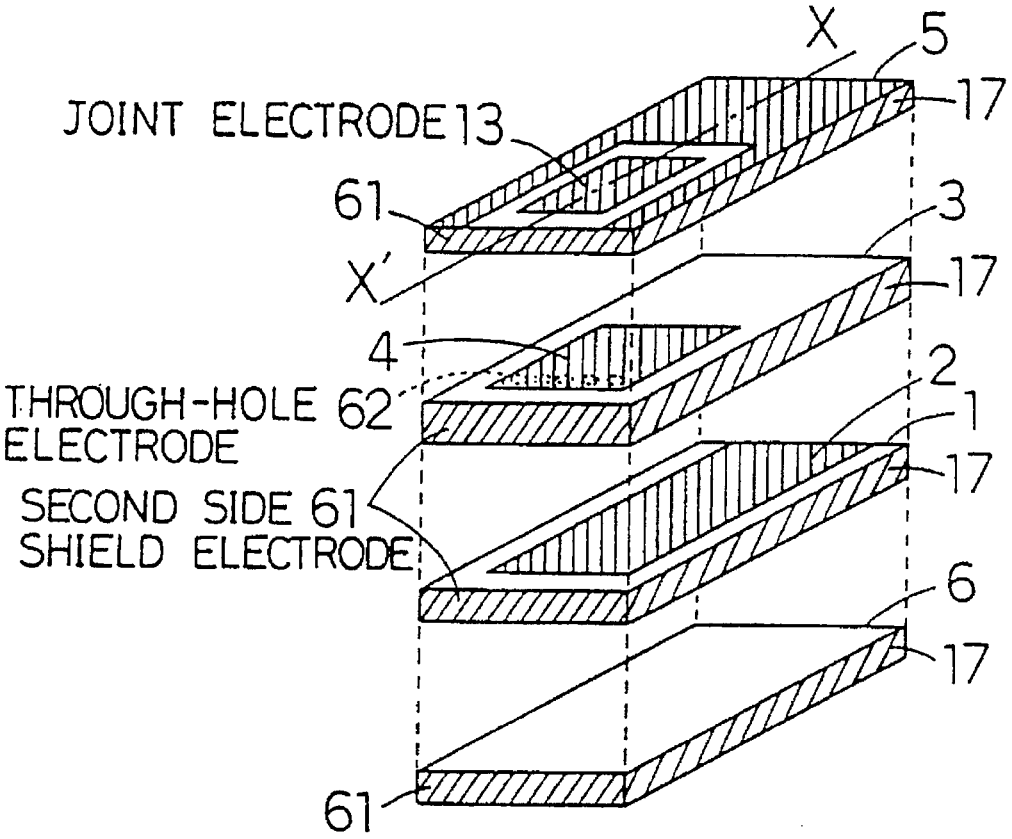
FIG. 4(*a*) is a perspective exploded view of a laminated dielectric resonator in a modified example of the third embodiment.
Figure 4B:
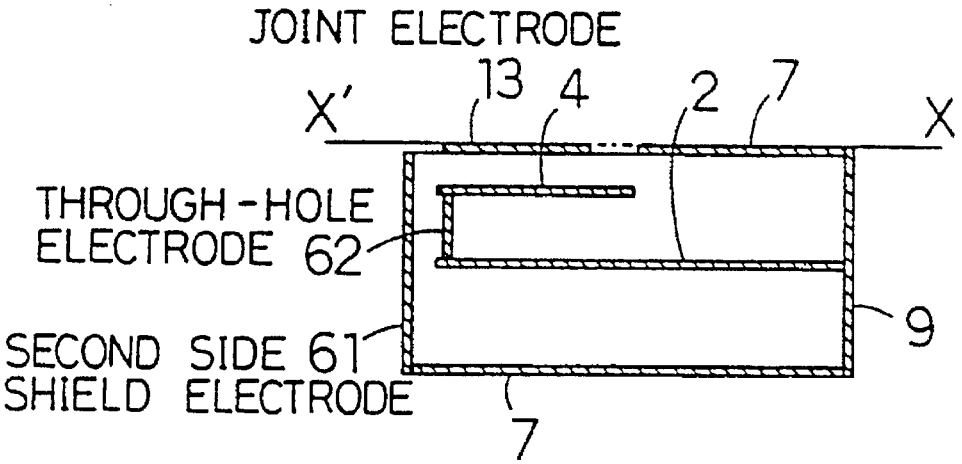

FIG. 4(*a*) is a perspective exploded view of a laminated dielectric resonator according to a modified example of the third embodiment of the present invention, and FIG. 4(*b*) is a section, taken along a line X–X' in FIG. 4(*a*).

In this modified example, different from the third embodiment, one end of the first strip line 2 is connected to one end of the second strip line 4 via a plurality of through hole electrodes 62 to form a second side shield electrode 61 on the side of the laminated body on the side of the through hole electrodes 62.

In the laminated dielectric resonator with the above construction, the end of the first strip line 2 and the end of the second strip line 4 are connected to each other via the plural through hole electrodes 62, which requires no extension of each strip line 2, 4 on the connected side (left end part in the figure) to the end of the dielectric sheets 1, 3. As a result, the second side shield electrode 61 is formed at the entire side surface of the laminated body on the connected side (i.e., side surface on through hole electrodes 62 side).

Accordingly, in this modified example, in addition to the same effects and features as in the third embodiment, almost complete shield characteristic is obtained since the entire laminated body except the part of the coupling electrode 13 is covered with the shield electrodes 7, side shield electrode 17, the second side shield electrode 61, and the ground electrode 9. Thus, the resonator invulnerable to external influence is easily obtained with the simple construction.

(ANOTHER MODIFIED EXAMPLE OF THE THIRD EMBODIMENT)

Figure 5A:
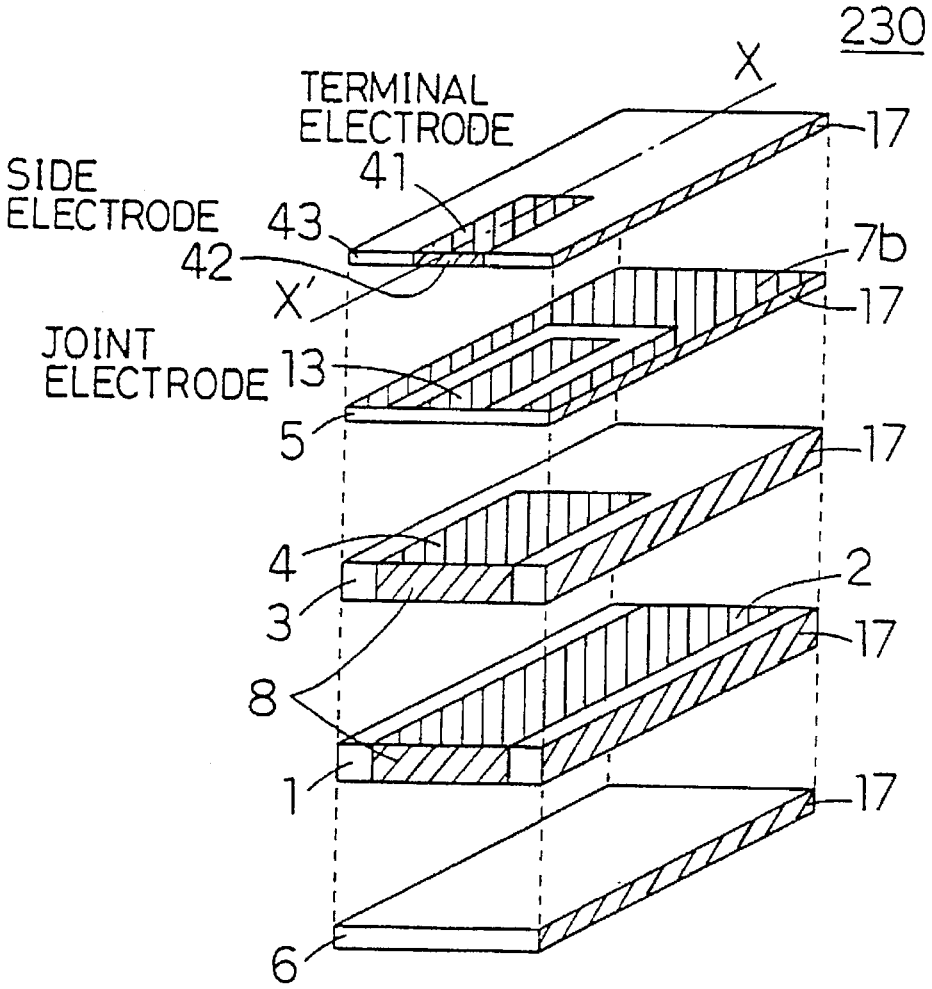
FIG. 5(*a*) is a perspective exploded view of a laminated dielectric resonator of another modified example of the third embodiment.
Figure 5B:
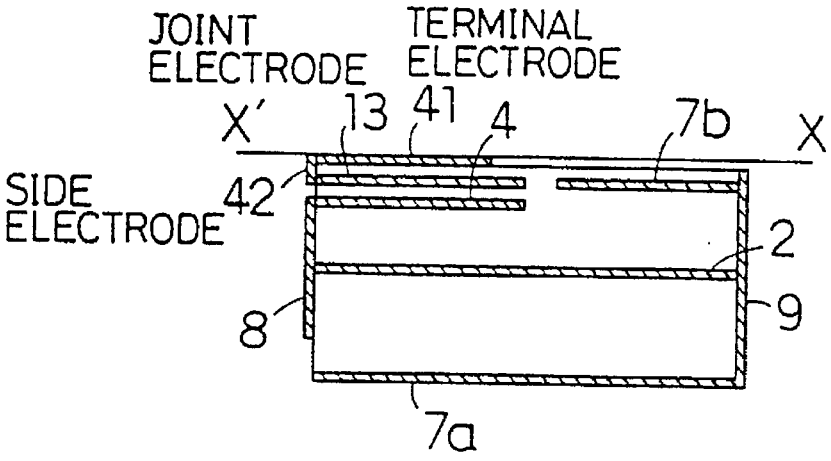

FIG. 5(*a*) is a perspective exploded view of a laminated dielectric resonator 230 according to another modified example of the third embodiment, and FIG. 5(*b*) is a section, taken along a line X–X' in FIG. 5(*a*).

In this modified example, another dielectric sheet 43 is further laminated on the dielectric sheet 5 to compose a coupling electrode 13 as the internal electrode. With the thus composed internal electrode, the coupling electrode 13 is formed at the same printing process as the formation of the strip line, which leads accurate coupling electrode 13 with less characteristic fluctuation.

Further, in order to connect the coupling electrode 13 to the external part, one terminal electrode 41 is formed, as the external electrode, on the upper surface of the dielectric sheet 43. A side electrode 42 connects the coupling electrode 13 to the terminal electrode 41. Without the side electrode 42, the coupling electrode 13 and the terminal electrode 41 may be connected by a through hole. The equivalent circuit of this modified example is identical with that in FIG. 4(*c*). Since size and shape of the terminal electrode 41 do not contribute to the capacity of the capacitor 15, no characteristic fluctuation due to change in shape of the terminal electrode 41 and implementation state of the laminated dielectric resonator to the circuit substrate is caused, which means easy handling of the laminated dielectric resonator in this modified example.

As described above, according to the third embodiment and the modified examples thereof, in addition to the same effects and features as those in the first embodiment, the resonator whose characteristic is to have the two resonances of series and parallel resonances, seen from the coupling electrode 13, can be easily formed by forming the capacitor 15 between the second strip line 4 and the coupling electrode 13.

(FOURTH EMBODIMENT)

Hereinafter discussed with reference to drawings is a dielectric filter according to the fourth embodiment of the present invention.

Figure 6A:
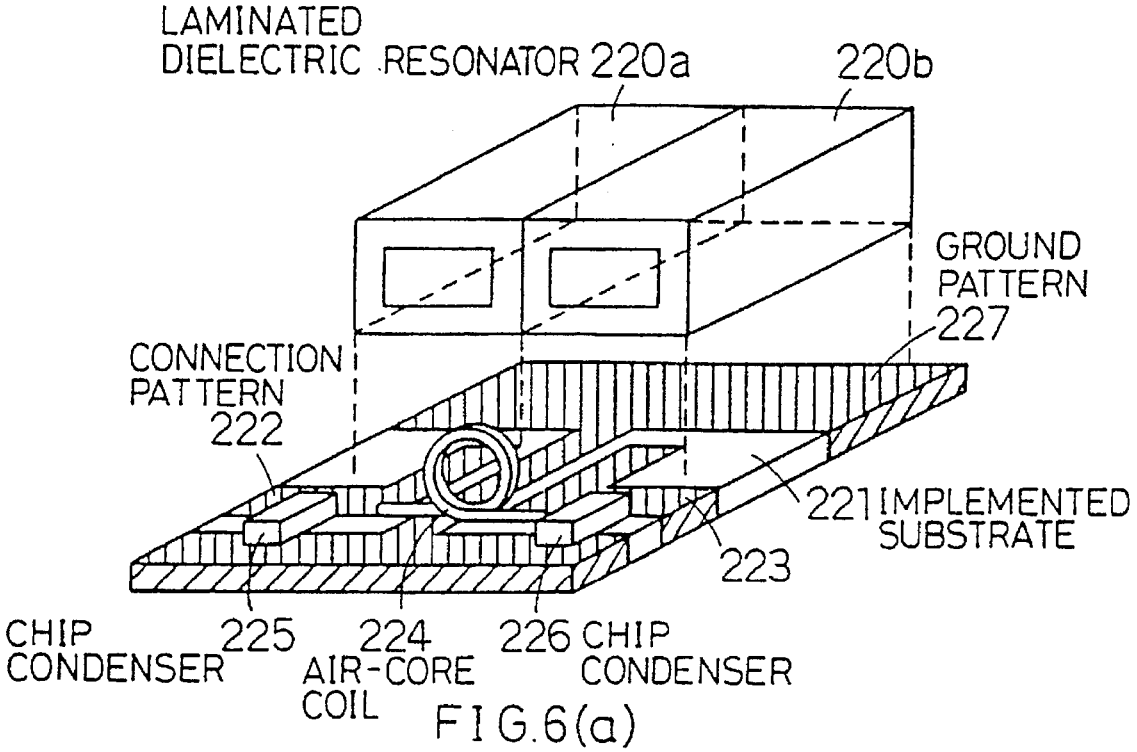
FIG. 6(*a*) is a perspective exploded view of a dielectric filter according to a fourth embodiment.
Figure 6B:
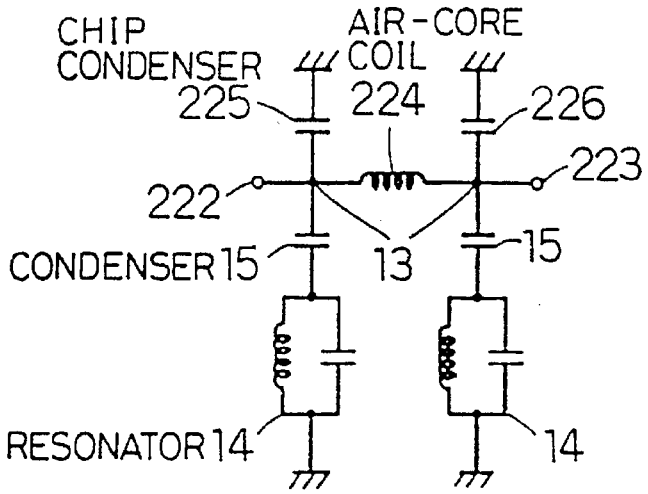

FIG. 6(*a*) is a perspective exploded view of the dielectric filter, which uses the laminated dielectric resonators 220 in the third embodiment, according to the fourth embodiment of the present invention. FIG. 6(*b*) is an equivalent circuit diagram of the dielectric filter in this embodiment.

Connection patterns 222, 223 and a ground pattern 227 are formed on an implemented substrate 221. The connection pattern 222 is connected to the coupling electrode 13 of a first laminated dielectric resonator **220*a*, to one end of an air-core coil 224 as an inductance and to one end of a chip capacitor 225. The connection pattern 223 on the implemented substrate 221 is connected to the coupling electrode 13 of a second laminated dielectric resonator 220*b*, to the other end of the air-core coil 224 and to one end of another chip capacitor 226. Further, the ground pattern 227 on the implemented substrate 221 is electrically connected to any among or all of the respective ground electrodes 8, the respective shield electrodes 7*a*, 7*b* and the respective side shield electrodes 17 of the laminated dielectric resonators 220*a*, 220*b* to be grounded. Each of the other ends of the chip capacitors 225, 226** is grounded, also.

Operation of the dielectric filter with the above construction is discussed next, with reference to FIG. 6(*b*).

The equivalent circuit to the laminated dielectric resonators **220*a*, 220*b*** is shown in FIG. 3(*c*) which work as resonators having two resonances of series resonance and parallel resonance. The impedance of the resonator is zero at the series resonant frequency, so that the resonators in cascade connection via the air-core coil 224 compose a band elimination filter. The chip capacitors 225, 226 connected in parallel to the resonators are compose a low pass filter together with the air-core coil 224 connected between the resonators to damp harmonic signal component and the like.

In the dielectric filter in this embodiment, a chip capacitor corresponding to the capacitor 15, which is generally required in the band elimination filter, and connection pins for connecting the resonator to the chip capacitor are unnecessary. The side shield electrodes 17 formed on both sides of the laminated body completely shields the resonator. As a result, surplus connection between the resonators is obviated even the laminated dielectric resonators are arranged adjacently, thus obtaining a excellent filter characteristic.

Hence, in the dielectric filter in this embodiment, the band elimination filter is easily constructed, with results of easy manufacturing, cost reduction, and size reduction of the dielectric filter.

In the dielectric filter in this embodiment, the plural dielectric resonators 220*a* are cascade-connected via the air-core coil 224 (inductance), but may be cascade-connected directly without the air-core coil 224. Further, the laminated dielectric resonator to be cascade-connected may be a conventional laminated dielectric resonator or a laminated dielectric resonator to be described later.

(FIFTH EMBODIMENT)

Described next with reference to the drawings is about a laminated dielectric resonator according to the fifth embodiment of the present invention.

Figure 7A:
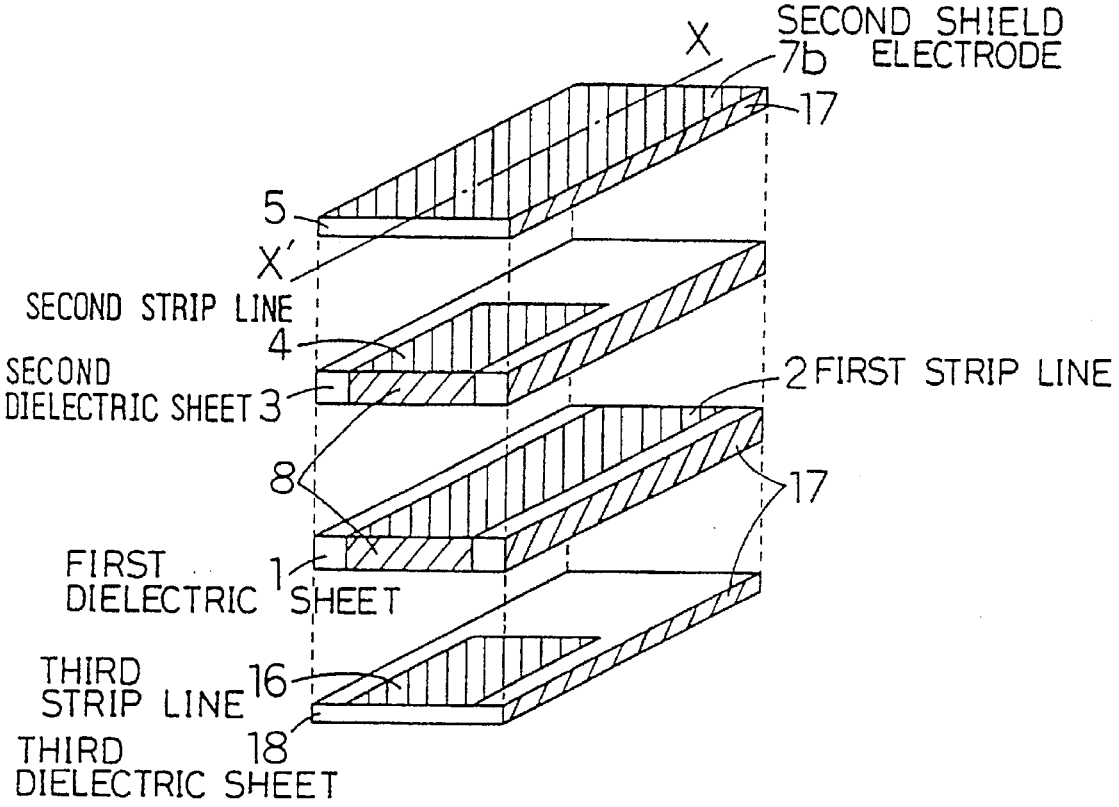
FIG. 7(*a*) is a perspective exploded view of a laminated dielectric resonator according to a fifth embodiment.
Figure 7B:
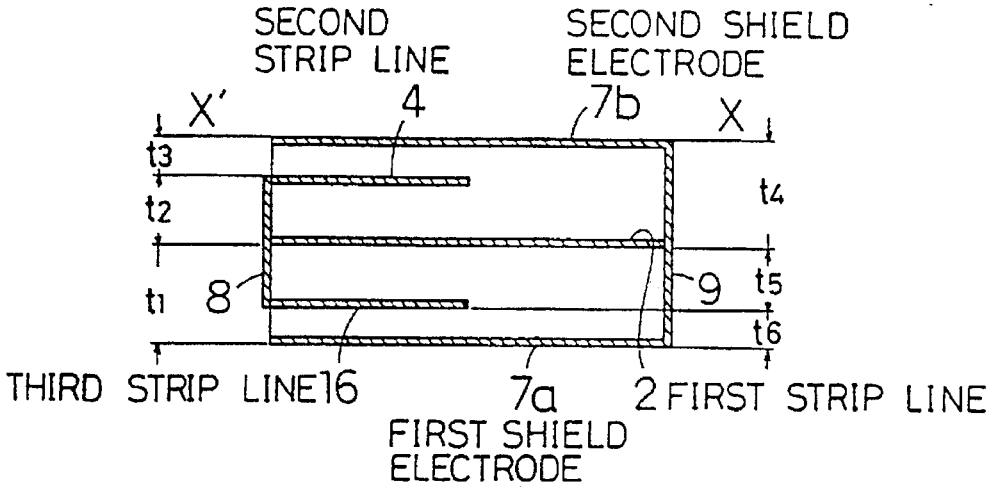

FIG. 7(*a*) is a perspective exploded view of a laminated dielectric resonator according to the fifth embodiment, and FIG. 7(*b*) is a section, taken along a line X–X' in FIG. 7(*a*). Wherein, the description is made, using the same references as in the first embodiment.

In FIGS. 7(*a*), (*b*), reference numeral 1 denotes a first dielectric sheet, 3 denotes a second dielectric sheet, 18 denotes a third dielectric sheet, 5 denotes another dielectric sheet. The low-temperature sintered dielectric ceramic used in the first embodiment is used for the dielectric sheets 1, 3, 18, 5.

A third strip line 16 is formed on the third dielectric sheet 18 by means of thick-film printing of conductor such as silver paste, copper paste. The first dielectric sheet 1 is laminated on the third dielectric sheet 18 at which the third strip line is formed. The first strip line 2 is formed on the first dielectric sheet 1 from one end to the other end of the first dielectric sheet 1 by the same means as the above. The second dielectric sheet 3 is laminated on the first dielectric sheet 1 at which the first strip line 2 is formed. The second strip line 4 which has the same figure as that of the third strip line 16 is formed on the second dielectric sheet 4.

Wherein, each length of the third strip line 16 and the second strip line 4 is shorter than that of the first strip line 2.

The dielectric sheet 5 is laminated on the second dielectric sheet 3. The thus laminated dielectric sheets 1, 3, 5, 18 are pressed and burnt concurrently with the internal electrodes interposed therebetween. The shield electrodes 7*a*, 7*b* respectively are formed, as external electrodes, on upper and lower surfaces of the thus burnt laminated body. The side shield electrodes 17 are respectively formed, as the external electrodes, on both sides of the laminated body. Respective one ends of the first strip line 2, the second strip line 4 and the third strip line 16 are connected to one another via the connection electrode 8 formed as the external electrode. The other end of the first strip line 2 is grounded via the ground electrode 9 formed as the external electrode. The external electrodes are formed in such a manner that silver paste mixed with glass frit for thick-film printing or the like is coated on the surface, then burnt. The connection electrode 8 also serves as a connection terminal to the external circuit.

A total thickness t1 of the third dielectric sheet 18 and the first dielectric sheet 1 (distance between the first shield electrode 7*a* and the first strip line 2), the thickness t2 of the second dielectric sheet 3 (distance between the first strip line 2 and the second strip line 4) and the thickness t3 of the uppermost dielectric sheet 5 (distance between the second strip line 4 and the second shield electrode 7*b*) are in relation of t1=t2+t3. A total thickness t4 (=t2+t3) of the uppermost dielectric sheet 5 and the second dielectric sheet 3 (distance between the second shield electrode 7*b* and the first strip line 2), the thickness t5 of the first dielectric sheet 1 (distance between the first strip line 2 and the third strip line 16), and the thickness t6 of the third dielectric sheet 18 (distance between the third strip line 16 and the first shield electrode 7*a*) are in relation of t4=t5+t6.

The laminated dielectric resonator with the above construction works as an end-short strip line resonator whose wave length is one fourth and in which the line is folded in two ways at an intermediate part on the open end side by connecting the respective one ends of the first strip line 2, the second strip line 4 and the third strip line 16 via the connection electrodes 8. In other words, the second strip line 4 and the third strip line 16 are connected in series to the first strip line 2, thereby the folded end-short strip line resonator is obtained, with reduced physical length of the resonator.

In this embodiment, the loading capacitance to be connected in parallel to the resonator is doubled compared with in the first embodiment. Since the second strip line 4 and the third strip line 16 are connected in parallel to each other, the characteristic impedance on the open end side of the resonator line is further lowered compared with that in the first embodiment. Thus, the length of the resonator is further reduced compared with that in the first embodiment.

Each length of the first strip line 2 and the second strip line 4 is set as follows.

When the second strip line 4 is longer, while the effect of folded strip line is increased to lower the resonant frequency, the unloaded Q is lowered to degrade the characteristic. An experiment, for example, for the laminated dielectric resonator in the fifth embodiment is conducted under conditions of low-temperature sintered dielectric material of 58 relative permittivity; 2.7 mm width of each dielectric sheet 1, 3, 5, 18; 2 mm line width of first and second strip lines 2, 4; 0.43 mm thicknesses of the dielectric sheet 3 between the first strip line 2 and the second strip line 4 and the dielectric sheet 5 between the second strip line 4 and the second shield electrode 7*b*; and 5.5 mm length L of the first strip line 2. The experimental results are that: the resonant frequency is 1300 MHz and the unloaded Q is 110 when the second strip line 4 is 0.35×L in length; and the resonant frequency is decreased to 1130 MHz and unloaded Q is degraded to 96 when the second strip line 2 is 0.65×L in length.

As cleared from the experimental results, further elongation of the second strip line 4 is unfavorable since the limit of the unloaded Q is about 96 for a practical resonator of the dielectric filter. Therefore, the length of the second strip line 4 is preferable to be set to not exceeding 0.65×L, preferably, set to be not exceeding 0.5×L, and set to be not exceeding 0.35×L for further high performance resonator. While, when the second strip line 4 is set to not exceeding 0.2×L, the effect of lowering the resonant frequency in the present invention is decreased. Therefore, the length of the second strip line 4 is preferable to set to be more than 0.2×L.

As described above, according to this embodiment, in addition to the effects and the features of the first embodiment, the resonant frequency is further reduced without degradation of the unloaded Q, and the whole length of the resonator is further reduced.

(SIXTH EMBODIMENT)

The sixth embodiment of the present invention is discussed below, with reference to the drawings.

In this embodiment, a capacitor electrode is added to the construction of the first embodiment. For easy understanding, the construction of a laminated dielectric resonator having only the capacitor electrode is discussed first.

Figure 8A:
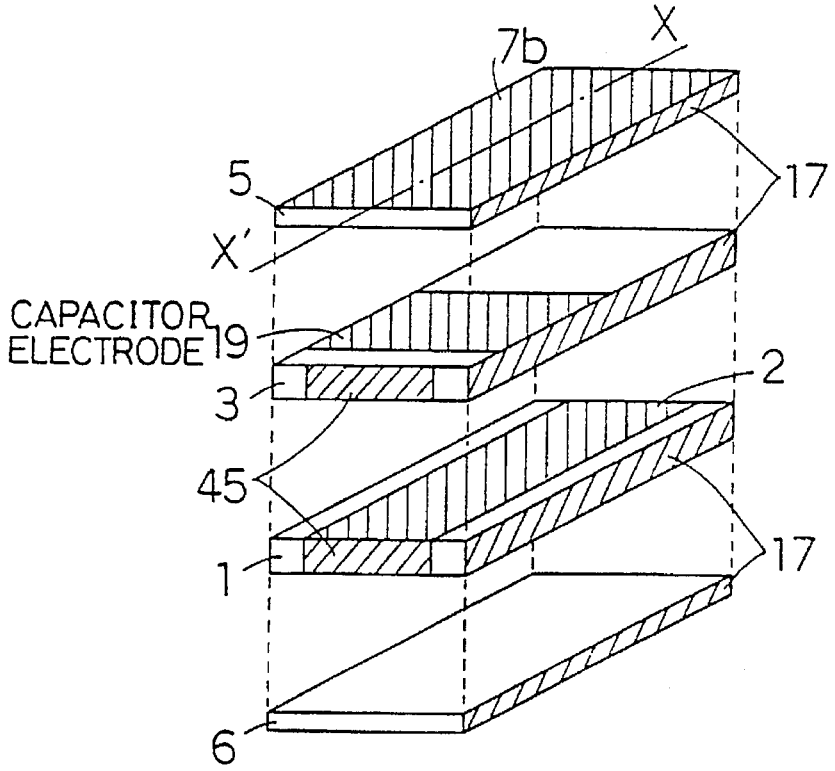
FIG. 8(*a*) is a perspective exploded view of a laminated dielectric resonator having a capacitor electrode.
Figure 8B:
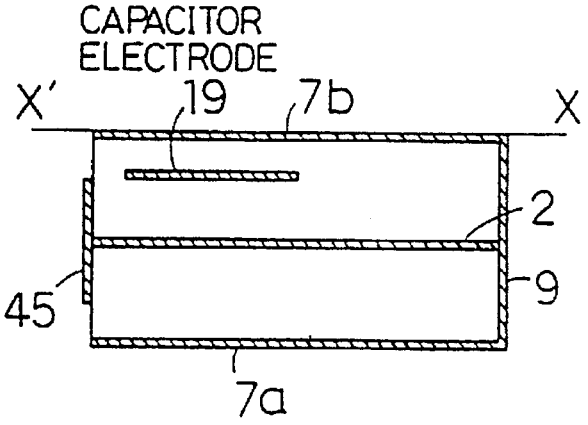
Figure 8C:
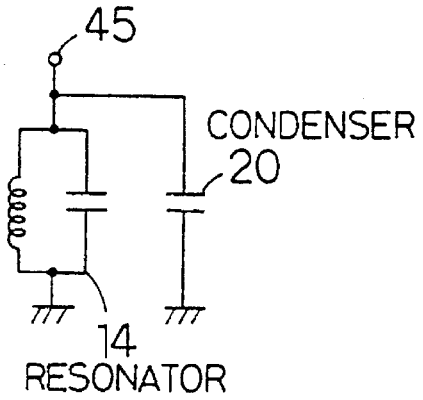

FIG. 8(*a*) is a perspective exploded view of the laminated dielectric resonator having the capacitor electrode, FIG. 8(*b*) is a section, taken along a line X–X' in FIG. 8(*a*) and FIG. 8(*c*) is an equivalent circuit diagram of the laminated dielectric resonator.

In FIGS. 8(*a*), (*b*), reference numeral 1 denotes a first dielectric sheet, 3 denotes a second dielectric sheet, 5 and 6 denote uppermost and lowermost dielectric sheets respectively. The same low-temperature sintered dielectric ceramic as in the first embodiment is used for these dielectric sheets 1, 3, 5, 6.

The first dielectric sheet 1 is laminated on the lowermost dielectric sheet 6. The strip line 2 is formed on the upper surface of the first dielectric sheet 1 by means of thick-film printing of the conductor such as silver paste, copper paste. One end (left end in FIG. 8(*a*)) of the strip line 2 is opened. The second dielectric sheet 3 is laminated on the first dielectric sheet 1 at which the strip line 2 is formed. The capacitor electrode 19 is formed on the upper surface of the second dielectric sheet 3 by the same means as the above so as to overlap the open end of the strip line 2. The capacitor electrode 19 extends to almost the center of the strip line 2 in the longitudinal direction. The uppermost dielectric sheet 5 is laminated on the second dielectric sheet 3.

All dielectric sheets 1, 3, 5, 6 laminated are pressed and burnt concurrently with the internal electrodes interposed therebetween. First and second shield electrodes 7*a*, 7*b* are respectively formed, as the external electrodes, at the upper and lower surfaces of the thus burnt laminated body. The side shield electrodes 17 as the ground electrodes are formed, as the external electrodes, on both sides of the thus burnt laminated body (i.e., laminated body of four dielectric sheets 1, 3, 5, 6) in the width direction of the strip line 2. The ground electrode 9 is formed, as the external electrode, on one entire side surface of the thus burnt laminated body in the longitudinal direction of the strip line 2, and the connection terminal 45 to the external circuit is formed, as the external electrode, on the other side surface thereof in the longitudinal direction of the strip line 2.

Further, the capacitor electrode 19 is grounded via the side shield electrodes 17, and one end of the strip line 2 (right end in FIG. 8(*a*)) is grounded via the ground electrode 9. The other end of the strip line 2 (left end in FIG. 8(*a*)) is opened and connected to the connection terminal 45. Each external electrode is formed in such a manner that the silver paste mixed with glass frit for thick-film printing is coated on the surface, then burnt.

Operation of the laminated dielectric resonator with the above construction is discussed, referring to the equivalent circuit shown in FIG. 8(*c*). First, the end-short strip line resonator composed of the strip line 2 is regarded as to compose the parallel resonator 14 which resonates in parallel at about the resonant frequency. The strip line 2 and the capacitor electrode 19 compose the capacitor 20. In this construction, the capacitor 20 is connected, as a loading capacitor, in parallel to the resonator 14 equivalently composed of the end-short strip line resonator. Accordingly, as the capacitance component of the resonator increases, the resonant frequency is lowered and the length of the resonator can be reduced.

On the open end side of the strip line 2, the distance between the open end part and the capacitor electrode 19 is short and the distance between the grounded end part of the strip line 2 and the shield electrode 7 is long, thus the characteristic impedance at the portion opposed to the capacitor electrode 19 of the strip line 2 is lower than the characteristic impedance on the grounded end side. Accordingly, the resonator composed of the strip line 2 is in SIR structure in which the impedance is changed in steps at the intermediate of the line, with a result of further decrease in resonant frequency.

The above effects, in total, results in remarkably short length of the resonator.

As the resonant frequency is lowered, dielectric material with less relative permittivity can be used. Therefore, the dielectric material with less dielectric loss tangent can be used without elongating the physical length of the resonator, improving the unloaded Q thereof.

Additionally, since the capacitor electrode 19 extends from the open end side to almost the center in the longitudinal direction of the strip line to cover the strip line 2, the capacitance component to be connected in parallel to the resonator becomes large and the resonant frequency of the resonator is further lowered, reducing the length of the resonator. Further, the electric field energy component is large at the open end side of the strip line and magnetic field energy component is large at the grounded end side thereof in the electromagnetic field distribution in the resonator. Therefore, in case where the capacitor electrode 19 is larger than one half of the whole length of the strip line 2, the effect of the length reduction is less and high-frequency current induced by the magnetic field energy flows to the capacitor electrode 19 to causes disadvantages of increased resistance loss and degradation of unloaded Q of the resonator. However, this embodiment has no disadvantages as such. The reduction of resonator length by SIR structure is maximum when the characteristic impedance of the strip line 2 is changed in steps at the center in the longitudinal direction of the resonator, which is of course attained in this embodiment.

Moreover, since the side shield electrodes 17 formed on both sides of the laminated body shield completely the both side surfaces of the resonator, electromagnetic interference between the laminated dielectric resonator and the external circuit and connection between the adjacently arranged resonators are prevented. The side shield electrodes 17 work to compellingly equalize the potential of the open end of the upper shield electrode 7 to the ground potential by connecting the upper and lower shield electrodes 7 to each other, thus preventing the shield electrodes 7 from unnecessary resonance at about the resonant frequency of the strip line resonator. Hence, with the side shield electrodes 17, as the external electrode, formed on both sides of the laminated body, the resonator with excellent shield characteristic and excellent resonant characteristic is obtained.

By grounding the capacitor electrode 19 via the side shield electrodes 17, assured grounding invulnerable to the influence of parasitic impedance is obtained, attaining the excellent resonant characteristic.

Further, by changing the capacitance of the capacitor 20 by adjusting the area of the capacitor electrode 19, the resonant frequency of the resonator is easily changed and adjusted, remaining the figure of the strip line 2 unchanged. This facilitates layout of the resonator.

Accordingly, with the above construction, small-sized, high-performance, easily-layouted laminated dielectric resonator is obtained.

Next, another construction of the laminated dielectric resonator having a capacitor electrode is discussed, with reference to the drawings.

Figure 9:
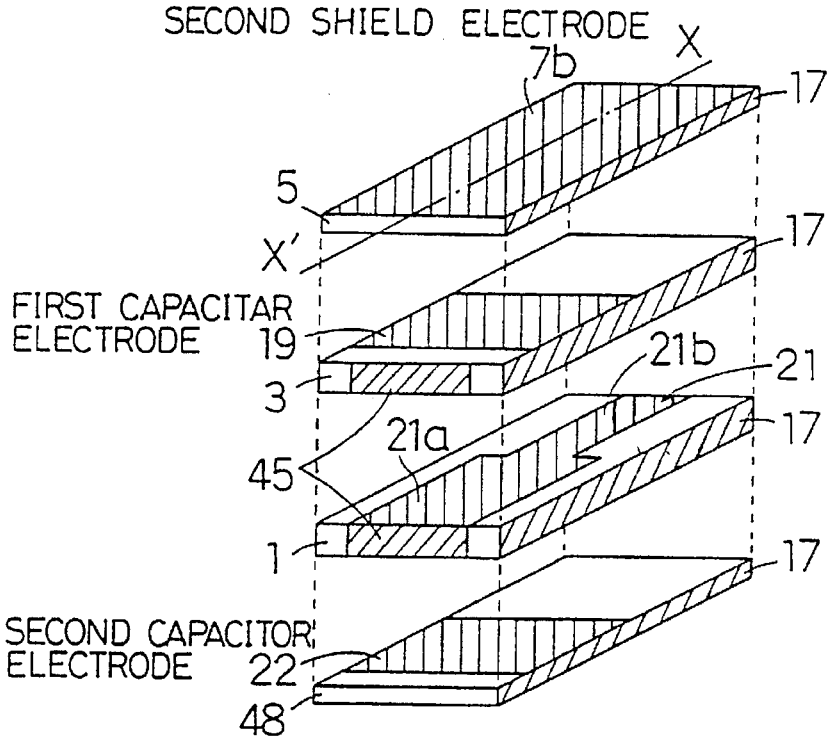
FIG. 9(*a*) is a perspective exploded view of another laminated dielectric resonator having a capacitor electrode.
Figure 9B:
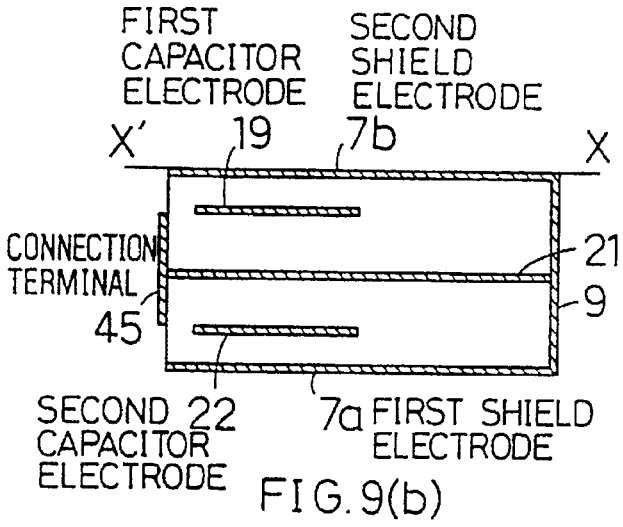
Figure 9C:
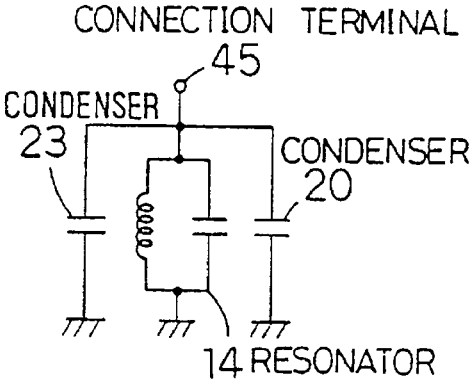

FIG. 9(*a*) is a perspective exploded view of another laminated dielectric resonator having a capacitor electrode, FIG. 9(*b*) is a section, taken along a line X–X' in FIG. 9(*a*) and FIG. 9(*c*) is an equivalent circuit diagram of the laminated dielectric resonator in this embodiment.

In FIGS. 9(*a*), (*b*), reference numeral 1 denotes a first dielectric sheet, 3 denotes a second dielectric sheet, 48 denotes a third dielectric sheet and 5 denotes another dielectric sheet. The same low-temperature sintered dielectric ceramic as in the first embodiment is used for these dielectric sheets 1, 3, 48, 5.

A second capacitor electrode 22 is formed on the third dielectric sheet 48 by means of thick-film printing of the conductor such silver paste, copper paste. The first dielectric sheet 1 is laminated on the third dielectric sheet 48 at which the second capacitor electrode 22 is formed, and a strip line 21 is formed on the upper surface of the first dielectric sheet 1 by the means as the above. The strip line 21 is formed in such a fashion that one end thereof (left end in FIG. 9(*a*)) is wide to be a wide part 21*a* and the other end thereof is narrow to be a narrow part 21*b*, in which the line width is made narrow from the intermediate part of the strip line 21.

The second dielectric sheet 3 is laminated on the first dielectric sheet 1 at which the strip line 21 is formed, and the first capacitor electrode 19 is formed on the upper surface of the second dielectric sheet 3. The first capacitor electrode 19 and the second capacitor electrode 22 are formed so as to overlap one open end of the strip line 21 under condition that first to third dielectric sheets 1, 3, 48 are laminated.

The other dielectric sheet 5 is laminated on the second dielectric sheet 3 at which the first capacitor electrode 19 is formed. These four dielectric sheets 1, 3, 5, 48 laminated are pressed, and burnt concurrently with the internal electrode interposed therebetween.

The first shield electrode 7*a* and the second shield electrode 7*b* are respectively formed, as the external electrodes, on upper and lower surfaces of the thus burnt laminated body, i.e., the lower surface of the third dielectric sheet 48 and the upper surface of the other dielectric sheet 5. On the entire side surfaces of the thus burnt laminated body in width direction, the side shield electrode 17 is formed as the external electrode, and the ground electrode 9 is formed, as the external electrode, on one side surface in the longitudinal direction.

The first capacitor electrode 19 and the second capacitor electrode 22 are grounded via the side shield electrodes 17 as the ground electrodes, and the other end (right end in FIG. 9(*a*)) of the strip line 21 is grounded via the ground electrode 9. At one end (left end in FIG. 9(*a*)) of the strip line 21, i.e. on the open end side, the connection terminal 45 to the external circuit is provided as the external electrode. Each external electrode is formed in such a manner that the silver paste mixed with glass frit for thick-film printing is coated on the surface, then burnt.

Operation of the thus constructed laminated dielectric resonator is described, with reference to the equivalent circuit shown in FIG. 9(*c*). The end-short strip line resonator composed of the strip line 21 can be regarded as to construct the parallel resonator 14 which resonates in parallel at about the resonant frequency. The capacitor 20 is formed by the strip line 21 and the capacitor electrode 19, and the capacitor 23 is formed by the strip line 21 and the capacitor electrode 22. Accordingly, in this construction, since the capacitors 20, 23 are connected, as the loading capacitors, in parallel to the resonator 14 equivalently composed of the end-short strip line resonator, the resonant frequency is lowered as the capacitance component of the resonator increases, thus reducing the length of the resonator. Also, in this construction, the loading capacitor to be connected in parallel to the resonator is doubled compared with that in the sixth embodiment. As a result, the resonant frequency of the resonator in this embodiment is lower than that in the sixth embodiment.

Since the strip line 21 is made wide at the open end and narrow at the other grounded end to restrict the line width on the other grounded end from the intermediate part of the strip line 21, the impedance step ratio of the SIR type resonator becomes further large. In other words, since the characteristic impedance of the strip line 21 is larger than a grounded end than at the open end, the length of the strip line 21 is further reduced.

Accordingly, the resonator with the above construction can further lower of the resonant frequency and further reduce the whole length thereof, in addition to the same effects as in the sixth embodiment.

Hereinafter discussed, with reference to the drawings, is the laminated dielectric resonator according to the sixth embodiment of the present invention.

Figure 10:
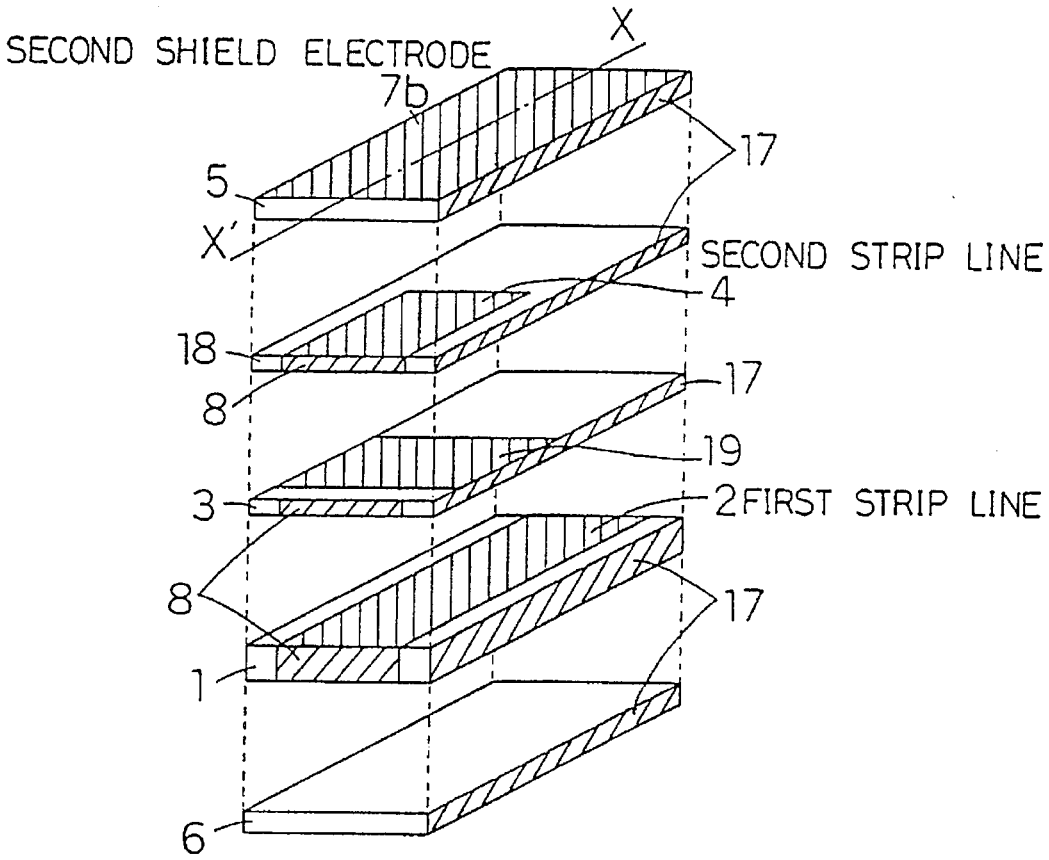
FIG. 10(*a*) is a perspective exploded view of a laminated dielectric resonator according to a sixth embodiment.
Figure 10B:
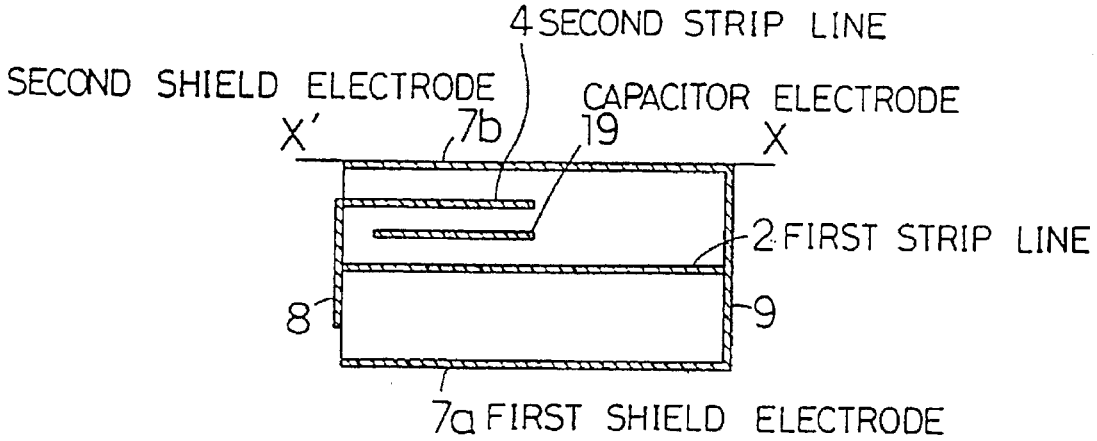

FIG. 10(*a*) is a perspective exploded view of the laminated dielectric resonator in the sixth embodiment and FIG. 9(*b*) is a section, taken along a line X–X' in FIG. 9(*a*).

In FIGS. 10(*a*), (*b*), reference numeral 1 denotes a first dielectric sheet, 3 denotes a second dielectric sheet, 18 denotes a third dielectric sheet, 5 and 6 denote uppermost and lowermost dielectric sheets respectively. The same low-temperature sintered dielectric ceramic as in the first embodiment is used for these dielectric sheets 1, 3, 18, 5, 6.

The first dielectric sheet 1 is laminated on the dielectric sheet 6. The first strip line 2 is formed on the upper surface of the first dielectric sheet 1 by means of thick-film printing of the conductor such as silver paste, copper paste so as to extent from one end to the other end of the first dielectric sheet 1. The second dielectric sheet 3 is laminated on the first dielectric sheet 1 at which the first strip line 2 is formed, and the capacitor electrode 19 is formed on the upper surface of the second dielectric sheet 3 by the same means as the above.

The third dielectric sheet 18 is laminated on the second dielectric sheet 3 at which the capacitor electrode 19 is formed. The second strip line 4 shorter than the first strip line 2 is formed on the upper surface of the third dielectric sheet 18 so as to extend from one end to the other end of the third dielectric sheet 18. The capacitor electrode 19 is formed so as to overlap the region thereof with the first strip line 2 and the second strip line 4 under the condition that first to third dielectric sheets 1, 3, 18 are laminated.

The dielectric sheet 5 is laminated on the third dielectric sheet 18 at which the second strip line 4 is formed. Each dielectric sheet laminated is pressed, and burnt concurrently with the internal electrodes interposed therebetween.

The first shield electrode 7*a* and the second shield electrode 7*b* are respectively formed, as the external electrodes, on upper and lower surfaces of the thus burnt laminated body, i.e., the lower surface the lowermost dielectric sheet 6 and the upper surface of the uppermost dielectric sheet 5. On both entire sides of the thus burnt laminated body in the width direction, the side shield electrodes 17 are respectively formed as the external electrode, and the capacitor electrode 19 is grounded via the side shield electrodes 17.

As shown in FIG. 10(*b*), the ground electrode 9 is formed as the external electrode, on one side of the thus burnt laminated body in the longitudinal direction, and one end of the first strip line 2 is connected to the ground electrode 9. On the other hand, the connection electrode 8 is formed, as the external electrode, on the other side of first to third dielectric sheets 1, 3, 18 in the longitudinal direction, and the other end of the first strip line 2 and one end of the second strip line 4 are connected to each other via the connection electrode 8. Each external electrode is formed in such a manner that the silver paste mixed with glass frit for thick-film printing is coated on the surface, then burnt. The connection electrode 8 is used also for the connection terminal to the external circuit.

The operation principle of the laminated dielectric resonator with the above construction is explained by a combination of the operation principles of the laminated dielectric resonator in the first embodiment and the laminated dielectric resonator having the capacitor electrode in FIG. 7. Therefore, in this embodiment, the resonant frequency is further lowered by the combination of the effects of the first embodiment and the laminated dielectric resonator in FIG. 7, which reduces the length of the resonator further.

Since the capacitor electrode 19 is formed between the first strip line 2 and the second strip line 4, the loading capacitance is formed between the second strip line 4 and the capacitor electrode 19 as well as between the first strip line 2 and the capacitor electrode 19, thus enlarging the loading capacitance. Consequently, the resonant frequency is further lowered.

As described above, according to this embodiment, in addition to the effects and features in the first embodiment and the laminated dielectric resonator having the capacitor electrode in FIG. 7, the loading capacitance can be enlarged, lowering the resonant frequency and reducing the whole length of the resonator.

(SEVENTH EMBODIMENT)

Description is made below about a laminated dielectric resonator according to the seventh embodiment, with reference to drawings.

Figure 11:
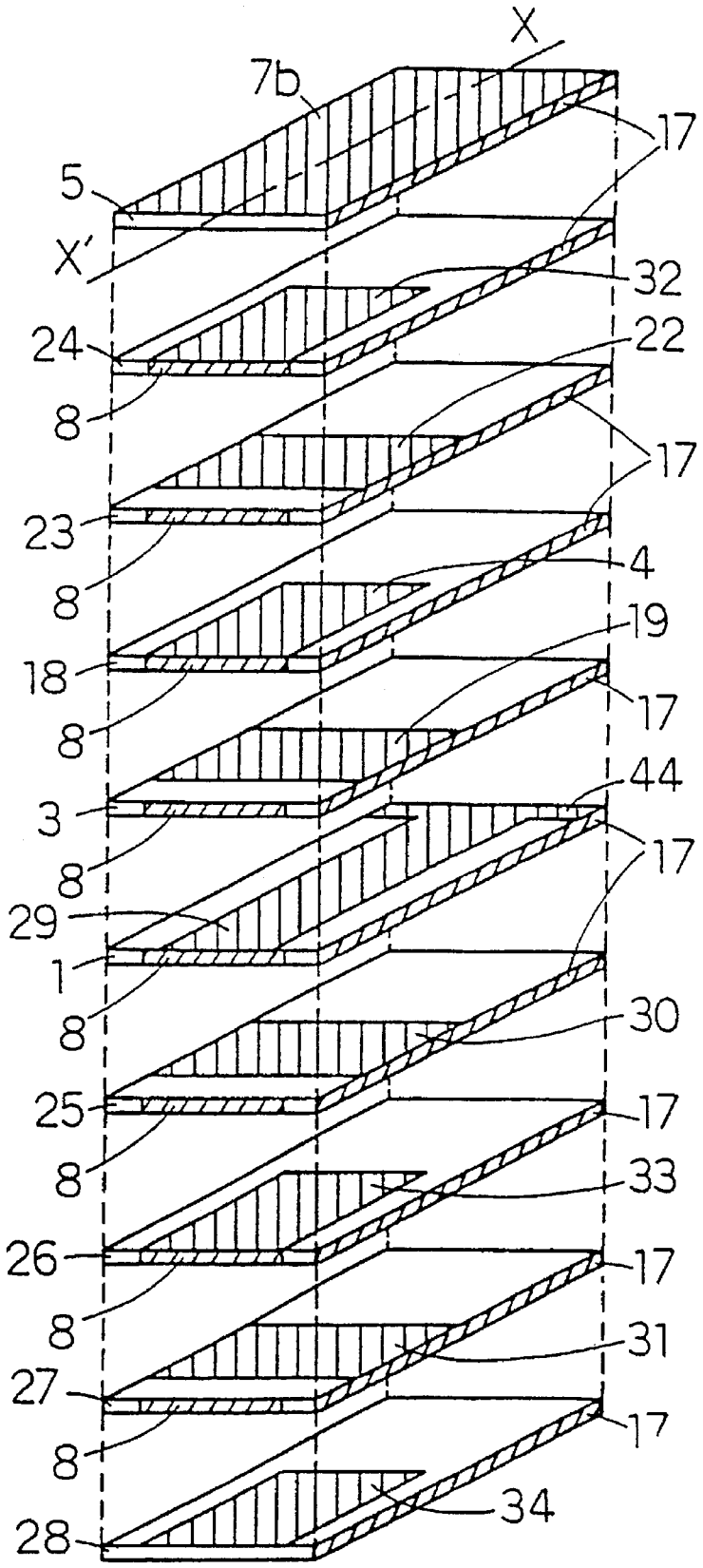
FIG. 11 is a perspective exploded view of a laminated dielectric resonator according to a seventh embodiment.
Figure 12:
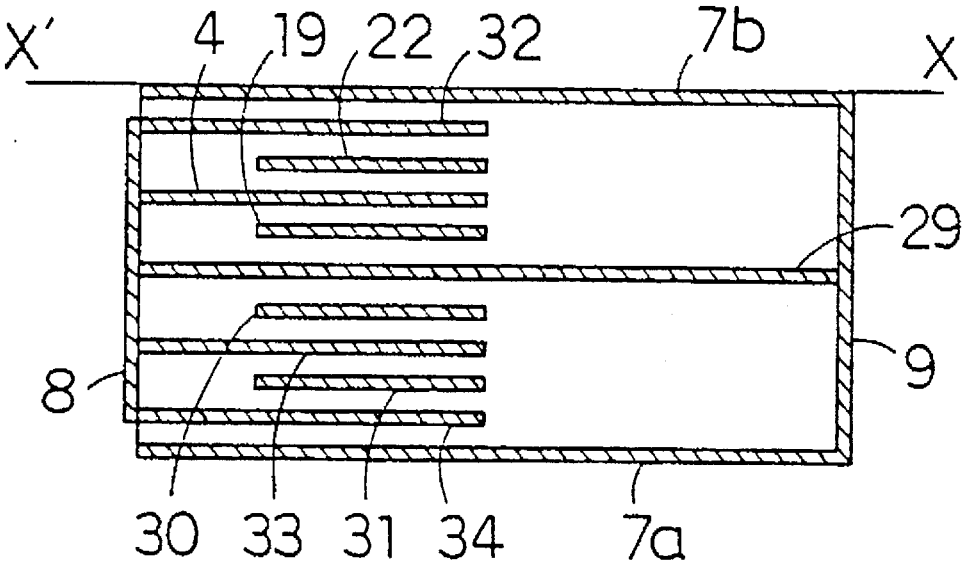
FIG. 12 is a section, taken along a line X–X' in FIG. 11.

FIG. 11 is a perspective exploded view of the laminated dielectric resonator in the seventh embodiment, and FIG. 12 is a section, taken along a line X–X' in FIG. 11.

The basic construction of the laminated dielectric resonator in this embodiment is a combination of the foregoing laminated dielectric resonators. In FIG. 11, reference numerals 1, 3, 5, 18, 23, 24, 25, 26, 27, 28 denote dielectric sheets. The same low-temperature sintered dielectric ceramic as in the first embodiment is used for the dielectric sheets 1, 3, 5, 18, 23, 24, 25, 26, 27, 28.

The first strip line 29 is formed on the first dielectric sheet 1 so as to extend from one end to the other end of the first dielectric sheet 1. First, second, third and fourth capacitor electrodes 19, 22, 30, 31 are formed respectively on second, fourth, sixth and eighth dielectric sheets 3, 23, 25, 27. Second, third, fourth and fifth strip lines 4, 32, 33, 34 which are shorter than the first strip line 29 are respectively formed on third, fifth, seventh and ninth dielectric sheets 18, 24, 26, 28 so as to extend from one end to the other end of the respective dielectric sheets 18, 24, 28.

An electrode region 44 whose line width is equal to the width of the first dielectric sheet 1 is formed at the other end (right end in FIG. 11) of the first strip line 29.

The ninth dielectric sheet 28, the eight dielectric sheet 27, the seventh dielectric sheet 26, the sixth dielectric sheet 25, the first dielectric sheet 1, the second dielectric sheet 3, the third dielectric sheet 18, the fourth dielectric sheet 23, the fifth dielectric sheet 24, and another dielectric sheet 5 are overlaid in this order. The capacitor electrode 19 is so formed that the region thereof overlaps with the first strip line 29 and the second strip line 4 under the laminated condition of the dielectric sheets, and the capacitor electrode 30 is so formed that the region thereof overlaps with the first strip line 29 and the fourth strip line 33 under the laminated condition of dielectric sheets. The capacitor electrode 22 is so formed that the region thereof overlaps with the second strip line 4 and the third strip line 32, and the capacitor electrode 31 is so formed that the region thereof overlaps with the fourth strip line 33 and the fifth strip line 34.

The respective dielectric sheets laminated are pressed, and burnt concurrently with the internal electrodes.

On upper and lower surfaces of the thus burnt laminated body, first and second shield electrodes 7*a*, 7*b* are respectively formed as the external electrodes. The side shield electrodes 17 are respectively formed, as the external electrodes, on both sides of the thus burnt laminated body in the width direction, and the capacitor electrodes 19, 22, 30, 31 are grounded via the side shield electrodes 17. The connection electrode 8 is formed, as the external electrode, on one side surface of the thus burnt laminated body in the longitudinal direction, and one end of the first strip line 29 is connected via the connection electrode 8 to each one end of second, third, fourth and fifth strip lines 4, 32, 33, 34. On the other side surface of the thus burnt laminated body in the longitudinal direction, the ground electrode 9 is formed, as the external electrode, to ground the electrode region 44 of the first strip line 29. Each external electrode is formed in such a manner that the silver paste mixed with glass frit for thick-film printing is coat on the surface, then burnt. The connection electrode 8 serves as also the connection terminal to the external circuit.

The operation principle of the thus constructed laminated dielectric resonator is basically the same as that of the laminated dielectric resonator in the sixth embodiment. In this embodiment, the construction in the sixth embodiment is laminated repeatedly in up and down direction for increasing the effects of the sixth embodiment.

In this embodiment, the electrode region 44 wider than the width of the first strip line 29 is provided on the grounded end side of the first strip line 29, and the first strip line 29 is connected and grounded, via the electrode region 44, to the ground electrode 9 or the side shield electrodes 17. Thus, the first strip line 29 is grounded positively, eliminating surplus inductance component and resistance component, which prevents fluctuation of the resonant frequency of the resonator and improves the unloaded Q.

As described above, according to this embodiment, in addition to the same effects and features as in the sixth embodiment, the length of the resonator is further reduced with large loading capacitance. Further, the connection of the grounded end of the strip line 29 is ensured, so that the laminated dielectric resonator with less fluctuation of the resonant frequency and high unloaded Q is attained.

(EIGHTH EMBODIMENT)

Described below with reference to drawings is about a laminated dielectric resonator according to the eighth embodiment of the present invention.

Figure 13A:
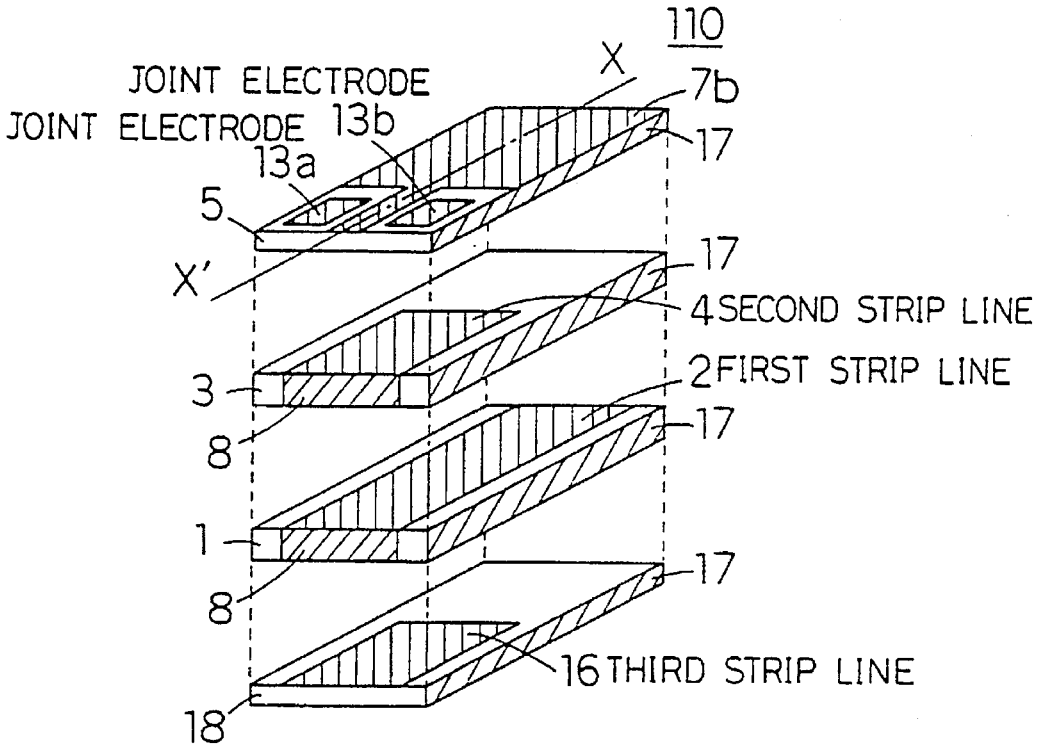
FIG. 13(*a*) is a perspective exploded view of a laminated dielectric resonator according to an eighth embodiment.
Figure 13B:
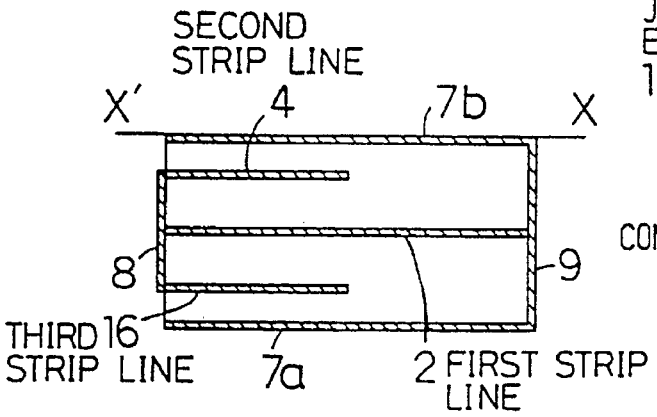
Figure 13C:
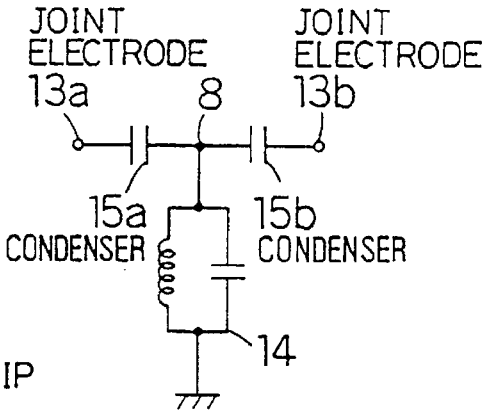

FIG. 13(*a*) is a perspective view of the laminated dielectric resonator 110 in the eighth embodiment, FIG. 13(*b*) is a section, taken along a line X–X' in FIG. 13(*a*) and FIG. 13(*c*) is an equivalent circuit diagram of the laminated dielectric resonator 110 in this embodiment.

Different from the fifth embodiment (FIGS. 7(*a*), (*b*)), in the laminated dielectric resonator 110 in FIGS. 13(*a*), (*b*), two coupling electrodes 13*a*, 13*b* are formed, as the external electrodes, on the surface, and compose a capacitor together with the second strip line 4, so that the capacitor connects the resonator to the external circuit. The other construction is the same as in the fifth embodiment.

Operation of the thus constructed laminated dielectric resonator 110 is discussed next, with reference to FIG. 13(*c*). The end-short strip line resonator in which first strip line 2 is connected to second and third strip lines 4, 16 is regarded as to construct the parallel resonator 14 which resonates in parallel at about the resonant frequency.

The second strip line 4 and the coupling electrodes 13*a*, 13*b* form the capacitors 15*a*, 15*b*. The coupling electrodes 13*a*, 13*b* serve as input/output terminals for connecting the laminated dielectric resonator to the external circuit. This circuit has a characteristic of single-step band pass filter in which the capacitors 15*a*, 15*b* serve input/output coupling capacitors of the parallel resonant circuit.

As described above, according to this embodiment, the simple single-pole band pass filter is easily constructed with the capacitors 15*a*, 15*b* respectively formed between the second strip line 4 and the coupling electrodes 13*a*, 13*b*, besides the same effects and features as in the fifth embodiment.

(NINTH EMBODIMENT)

Referring to the drawings, the ninth embodiment is described below.

Figure 14:
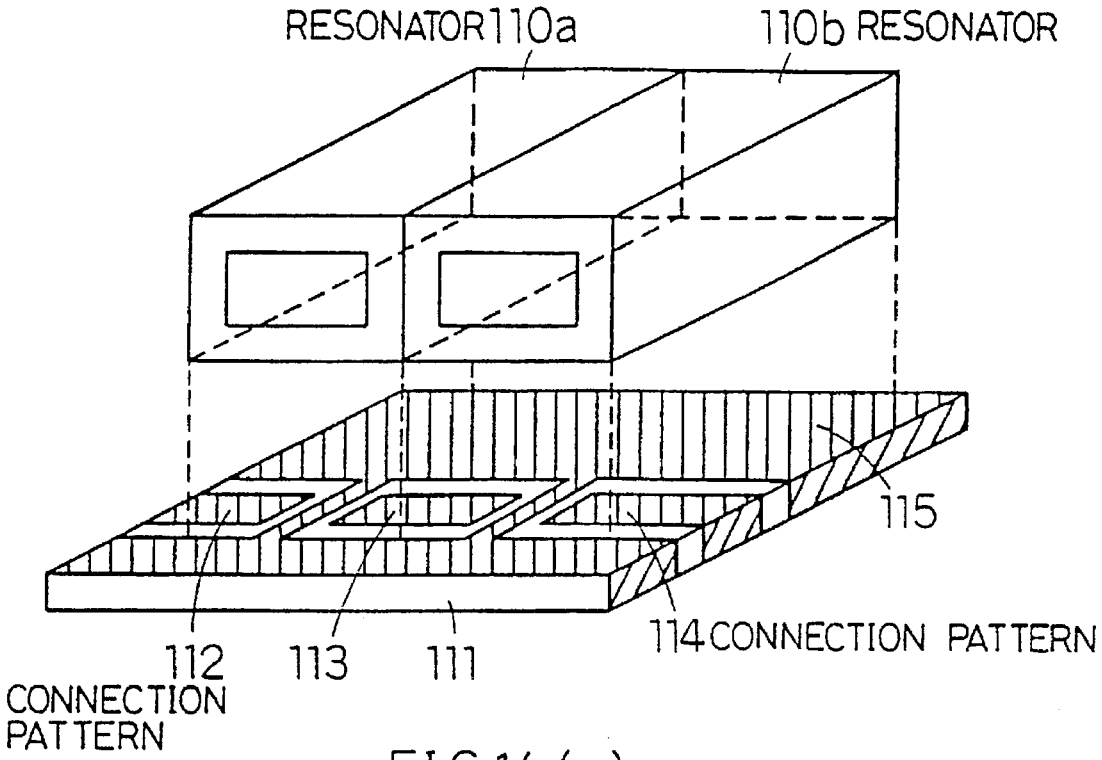
FIG. 14(*a*) is a perspective exploded view of a dielectric filter according to a ninth embodiment.
Figure 14B:
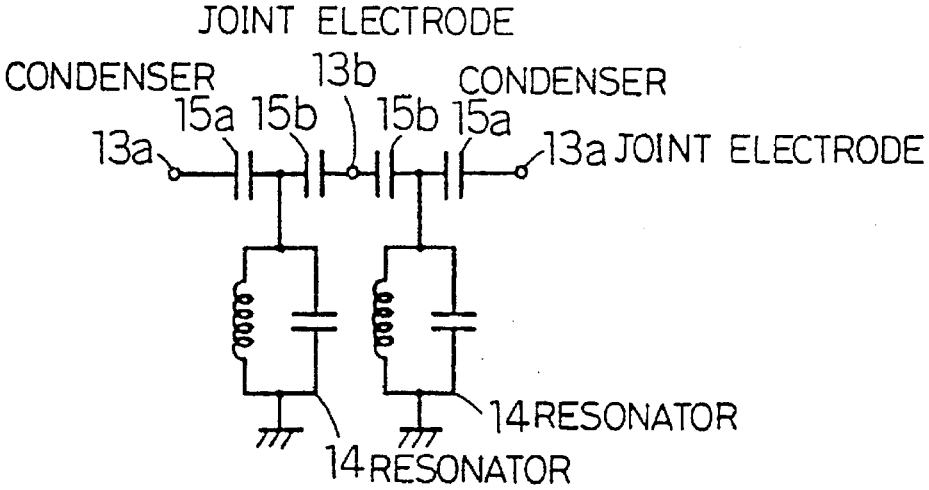
Figure 15:
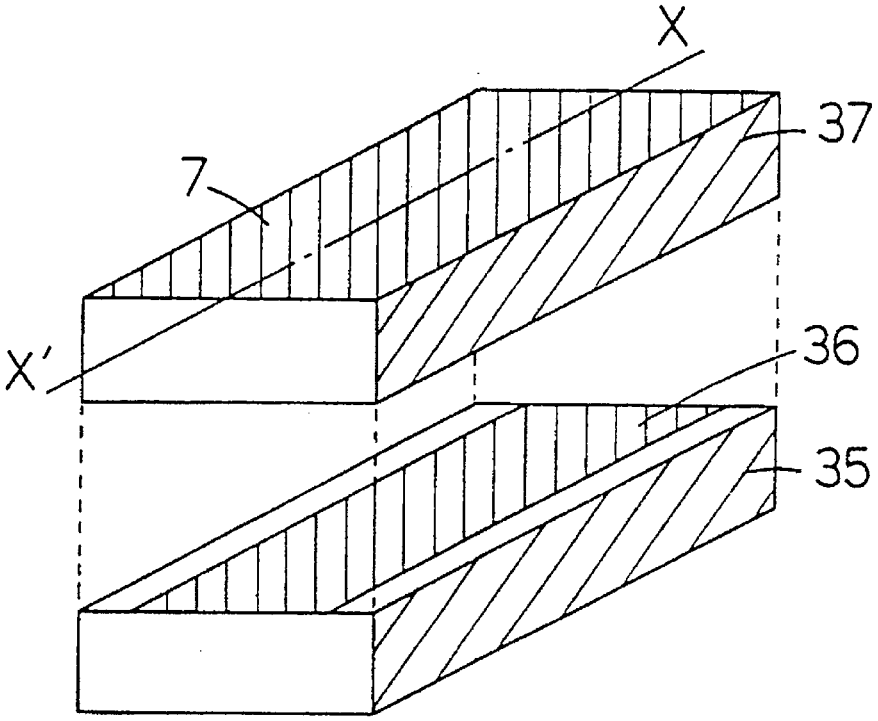
FIG.15 (a) (PRIOR ART)
FIG. 15(*a*) is a perspective exploded view of a conventional laminated dielectric resonator.
Figure 15B:
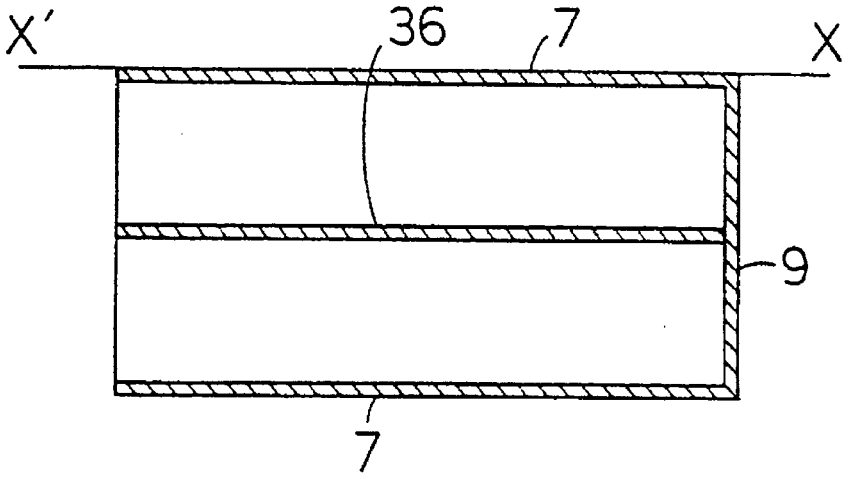
FIG.15(b) (PRIOR ART)
Figure 16:
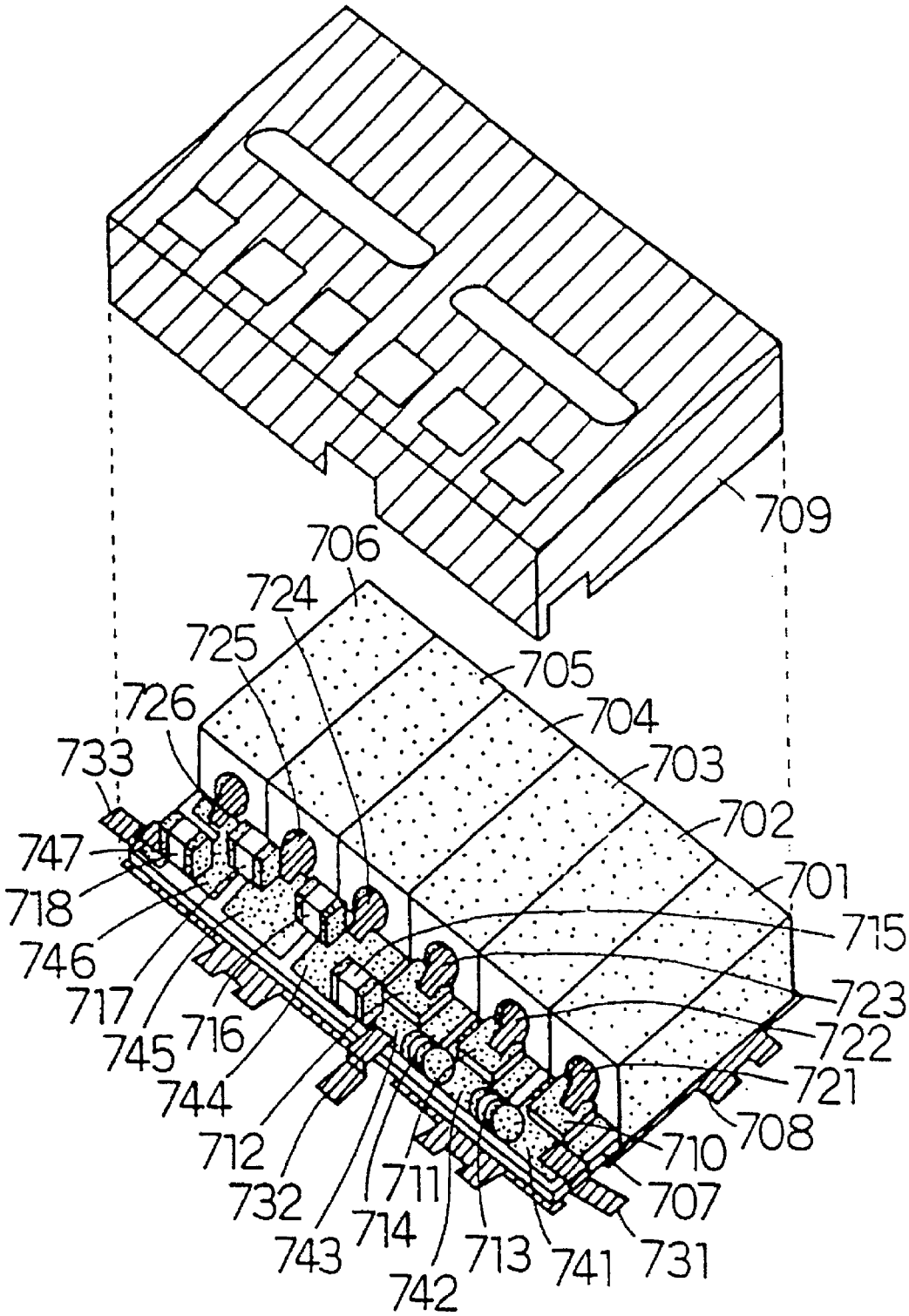
FIG. 16 (PRIOR ART)
FIG. 16 is a perspective exploded view of an antenna duplexer composed of the conventional dielectric filter.

FIG. 14(*a*) is a perspective exploded view of a laminated dielectric filter according to the ninth embodiment, in which the laminated dielectric resonators 110 in the eighth embodiment are connected in multi-pole to one another.

Three connection patterns 112, 113, 114 and a ground pattern 115 are formed on an implemented substrate 111. A coupling electrode 13*a* of a first laminated dielectric resonator 110*a* is connected to the connection pattern 112. The coupling electrode 13*b* of the first laminated dielectric resonator 110*a* and a coupling electrode 13*b* of a second laminated dielectric resonator 110*b* are connected to the connection pattern 113. A coupling electrode 13*a* of the second laminated dielectric resonator 110*b* is connected to the connection pattern 114. To the ground pattern 115, all of or any among the respective ground electrodes 8, the respective shield electrodes 7 and the respective side shield electrodes 17 of the laminated dielectric resonators 110*a*, 110*b* are/is electrically connected.

Operation of the thus constructed dielectric filter discussed next, with reference to the equivalent circuit diagram of FIG. 14(*b*).

When the laminated dielectric resonators 110*a*, 110*b* are cascade-connected to each other, the respective capacitors 15*b* of the laminated dielectric resonators 110*a*, 110*b* are connected in series to each other to work as inter-resonator coupling capacitors. The respective capacitors 15*a* of the laminated dielectric resonators 110*a*, 110*b* work as input/output coupling capacitors. Accordingly, a multi-pole filter of capacitance coupling type is constructed, with a result of a multi-pole band pass filter having excellent selection characteristic, e.g. Tchebysheff characteristic.

Chip condensers corresponding to the condensers 15*a*, 15*b* and connection pins for connecting the resonator to the electrode pattern on the implemented substrate, which are generally required in a band pass filter, are unnecessary.

With the side shield electrodes 17, the resonator is completely shielded, with a result that excellent filter characteristic is obtained without extra joint between the resonators even though the laminated dielectric resonators are arranged adjacently.

As described above, according to this embodiment, the multi-step band pass filter with excellent selection characteristic is easily obtained. The chip condensers and connection pins required for the conventional band pass filter is unnecessary, thus facilitating the manufacturing process and reducing the cost and size of the dielectric filter.

In each embodiment, a single resonator in which one strip line resonator is formed on the dielectric sheet is described. However, the present invention is applicable to a case where two or more strip line resonators are formed thereon. In this case, it is possible that the strip line resonators are connected in electromagnetic field to one another to compose the filter by the thus connected body. This invention is effective as a technique for reducing the length of each strip line resonator composing the filter. Hence, the invention includes, of course, a laminated dielectric filter with such a construction.

Further, in the above description, the laminated dielectric resonator is applied to the dielectric filter only. However, the laminated dielectric resonator in this invention may be used as a resonant element for stabilizing oscillation frequency of a high-frequency oscillation circuit such as voltage controlled oscillator (VCO).

We claim:

1. A laminated dielectric resonator, comprising:

a first dielectric sheet;

other plural dielectric sheets;

an uppermost dielectric sheet and a lowermost dielectric sheet;

a first strip line formed at the first dielectric sheet;

a capacitor electrode formed at each of some sheets of the other plural dielectric sheets;

a second strip line formed at each of the other sheets of the other plural dielectric sheets, the plural dielectric sheets at which the respective capacitor electrodes are formed and the plural dielectric sheets at which the respective second strip lines are formed being laminated alternately, the first dielectric sheet being laminated under the thus alternately laminated body of the plural dielectric sheets, and the thus laminated body and the first dielectric sheet being laminated with the uppermost and lowermost dielectric sheets respectively located on and under the thus laminated body and the first dielectric sheet;

a first shield electrode provided on an upper surface of the lowermost dielectric sheet;

a second shield electrode provided on an upper surface of the uppermost dielectric sheet;

a connection electrode which connects one end of the first strip line and each one end of the second strip lines;

a ground electrode which grounds the other end of the first strip line; and side shield electrodes respectively provided as external electrodes on both side surfaces of the laminated dielectric resonator, connecting the first shield electrode and the second shield electrode, wherein the capacitor electrodes are grounded through the side shield electrodes, lengths of the second strip lines and the capacitor electrodes are shorter than that of the first strip line, each other end of the second strip lines is opened, and the second strip lines and the capacitor electrodes are overlapped on a portion of the first strip line which is in the vicinity of the connection electrode, while except for this portion, the first strip line is confronting the first shield electrode and the second shield electrode without any other electrode therebetween.

2. A laminated dielectric resonator, comprising:

a first dielectric sheet:

other plural dielectric sheets:

a first strip line formed at the first dielectric sheet:

a capacitor electrode formed at each of some sheets of the other plural dielectric sheets:

a second strip line formed at each of the other sheets of the other plural dielectric sheets, the plural dielectric sheets at which the respective capacitor electrodes are formed and the plural dielectric sheets at which the respective second strip lines are formed being laminated alternately, the first dielectric sheet being laminated on a half of the thus laminated body of alternately laminated plural dielectric sheets, and the other half of the thus laminated body thereof being laminated on the first dielectric sheet;

an uppermost dielectric sheet and a lowermost dielectric sheet respectively arranged and laminated on and under the thus laminated body;

a first shield electrode provided on an under surface of the lowermost dielectric sheet;

a second shield electrode provided on an upper surface of the uppermost dielectric sheet;

a connection electrode which connects one end of the first strip line to each one end of the second strip lines; and a ground electrode which grounds the other end of the first strip line and each capacitor electrode, wherein regions of the first strip line, each second strip line and each capacitor electrode overlap one another, the other end of each second strip line is opened, a distance t1 between the first shield electrode and the first strip line is set different from distances t2 between the first strip line and each second strip line and distances t3 between each second strip line and the second shield electrode.

3. The laminated dielectric resonator of claim 1, wherein a distance t1 between the first shield electrode and the first strip line is set different from a distance t2 between the first strip line and the second strip line and a distance t3 between the second strip line and the second shield electrode.

4. The laminated dielectric resonator of either of claims 1 or 2, wherein $t1>t2>t3$.

5. The laminated dielectric resonator of either of claims 1 or 2, wherein $t1>t3>t2$.

6. The laminated dielectric resonator of either of claims 1 or 2, wherein $t1=t2+t3$.

7. The laminated dielectric resonator of either of claims 1 or 2, wherein a length L of the second strip line is set to $0.2L1 \leqq L \leqq 0.65L1$, wherein L1 is a length of the first strip line.

8. The laminated dielectric resonator of either of claims 1 or 2, wherein a length L of the second strip line is set to $0.2L1 \leqq L \leqq 0.5L1$, wherein L1 is a length of the first strip line.

9. The laminated dielectric resonator of either of claims 1 or 2, wherein a length L of the second strip line is set to $0.2L1 \leqq L \leqq 0.35L1$, wherein L1 is a length of the first strip line.

10. The laminated dielectric resonator of either of claims 1 or 2, wherein the end of the first strip line which is connected to the connection electrode is formed wide, the other end thereof which is grounded is formed narrow, and the first strip line is formed narrow from an intermediate part thereof to the other end thereof which is grounded.

11. The laminated dielectric resonator of either of claims 1 or 2, wherein the uppermost and lowermost dielectric sheets are laminated with two dielectric sheets respectively disposed thereon and thereunder, and each shield electrode is formed as an internal electrode interposed between the two dielectric sheets.

12. The laminated dielectric resonator of either of claims 1 or 2, wherein each shield electrode is formed as an external electrode located on a surface of the laminated dielectric resonator.

13. The laminated dielectric resonator of either of claims 1 or 2, further comprising at least one coupling electrode to be connected to an external circuit, wherein the coupling electrode and the second strip line compose a capacitor.

14. The laminated dielectric resonator of claim 13, wherein the coupling electrode is formed as an external electrode located on a surface of the laminated dielectric resonator.

15. The laminated dielectric resonator of claim 13, wherein the coupling electrode is formed as an internal electrode located between the uppermost and the lowermost dielectric sheets.

16. The laminated dielectric resonator of claim 13, further comprising at least one terminal electrode of a same number as that of the coupling electrode which are respectively connected to the corresponding coupling electrode, wherein the terminal electrode is formed as an external electrode located on the surface of the laminated dielectric resonator.

17. The laminated dielectric resonator of claim 13, wherein the coupling electrode is formed on a surface of the dielectric sheet at which the second shield electrode is formed.

18. The laminated dielectric resonator of either of claims 1 or 2, wherein the connection electrode is a through hole electrode formed at the second dielectric sheet, the ends of the first strip line and the second strip line on a side connected by the through hole electrode are located inside of the ends of the first dielectric sheet and the second dielectric sheet, a second side shield electrode is arranged at the ends of the first dielectric sheet and the second dielectric sheet, and the ground electrode is arranged at the other ends of the first dielectric sheet and the second dielectric sheet.

19. The laminated dielectric resonator of either of claims 1 or 2, wherein an electrode region wider than a line width of the first strip line is formed at an end of the first strip line on grounded side, and the first strip line is connected to the ground electrode via the electrode region.

20. A dielectric filter, in which a plurality of the laminated dielectric sheets of claim 13 are cascade-connected to one another.

21. A dielectric filter, in which a plurality of the laminated dielectric sheets of claim 16 are cascade-connected to one another.

22. The dielectric filter of either of claims 20 or 21, wherein the plural laminated dielectric resonators are respectively cascade-connected to one another via inductances.

* * * * *

UNITED STATES PATENT AND TRADEMARK OFFICE

CERTIFICATE OF CORRECTION

PATENT NO. : 5,654,681

DATED : August 5, 1997

INVENTOR : Ishizaki et al.

It is certified that error appears in the above-identified patent and that said Letter Patent is hereby corrected as shown below:

In the claims:

Claim 4, line 1, change "1" to --3--.

Claim 5, line 1, change "1" to --3--.

Claim 6, line 1, change "1" to --3--.

Signed and Sealed this

Twenty-fifth Day of April, 2000

*Attest:*

Q. TODD DICKINSON

*Attesting Officer*

*Director of Patents and Trademarks*